US009410715B2

(12) United States Patent
Honda et al.

(10) Patent No.: US 9,410,715 B2
(45) Date of Patent: Aug. 9, 2016

(54) AIR CONDITIONING APPARATUS

(71) Applicants: DAIKIN INDUSTRIES, LTD., Osaka-shi, Osaka (JP); DAIKIN EUROPE N.V., Oostende (BE)

(72) Inventors: Masahiro Honda, Oostende (BE); Shinya Matsuoka, Sakai (JP); Hideyuki Nakagawa, Sakai (JP)

(73) Assignees: Daikin Industries, Ltd., Osaka (JP); Daikin Europe N.V., Oostende (BE)

( * ) Notice: Subject to any disclaimer, the term of this patent is extended or adjusted under 35 U.S.C. 154(b) by 0 days.

(21) Appl. No.: 14/434,683

(22) PCT Filed: Oct. 18, 2012

(86) PCT No.: PCT/JP2012/076932
§ 371 (c)(1),
(2) Date: Apr. 9, 2015

(87) PCT Pub. No.: WO2014/061129
PCT Pub. Date: Apr. 24, 2014

(65) Prior Publication Data
US 2015/0285530 A1 Oct. 8, 2015

(51) Int. Cl.
*F24F 11/02* (2006.01)
*F25B 13/00* (2006.01)
(Continued)

(52) U.S. Cl.
CPC ..... *F24F 11/02* (2013.01); *F24F 5/0035* (2013.01); *F25B 13/00* (2013.01);
(Continued)

(58) Field of Classification Search
CPC ..... F24F 2011/0045; F25B 2313/0233; F25B 2313/02331
See application file for complete search history.

(56) References Cited

U.S. PATENT DOCUMENTS 4,821,527 A 4/1989 Suzuki et al.
5,884,497 A * 3/1999 Kishita ..... B60H 1/3205 62/193
(Continued)

FOREIGN PATENT DOCUMENTS

EP 2 204 622 A1 7/2010
JP 4-151463 A 5/1992
(Continued)

OTHER PUBLICATIONS

European Search Report of corresponding EP Application No. 12 88 6852.8 dated Jun. 24, 2015.
(Continued)

*Primary Examiner* — Ljiljana Ciric
*Assistant Examiner* — Alexis Cox
(74) *Attorney, Agent, or Firm* — Global IP Counselors

(57) ABSTRACT

An air conditioning apparatus has a refrigerant circuit made up of plural indoor units connected to an outdoor unit, and the air conditioning apparatus has a capacity controlling part and a target refrigerant temperature mode setting part. The capacity controlling part controls the air conditioning capacity of the outdoor unit in such a way that the evaporation temperature of refrigerant in the refrigerant circuit becomes a target evaporation temperature, or in such a way that the condensation temperature of the refrigerant becomes a target condensation temperature. The target refrigerant temperature mode setting part is configured to seta target refrigerant temperature mode to either a target refrigerant temperature changing mode or a target refrigerant temperature fixing mode. The target refrigerant temperature changing mode changes the target evaporation temperature or the target condensation temperature, and the target refrigerant temperature fixing mode fixes the target evaporation temperature or the target condensation temperature.

21 Claims, 11 Drawing Sheets

(51) Int. Cl.
*F24F 5/00* (2006.01)
*F24F 11/00* (2006.01)

(52) U.S. Cl.
CPC .. *F24F 2011/0045* (2013.01); *F25B 2313/029* (2013.01); *F25B 2313/0233* (2013.01); *F25B 2313/02741* (2013.01); *F25B 2313/0313* (2013.01); *F25B 2313/0314* (2013.01); *F25B 2600/19* (2013.01); *F25B 2600/21* (2013.01); *F25B 2700/1931* (2013.01); *F25B 2700/1933* (2013.01); *F25B 2700/2106* (2013.01); *F25B 2700/21151* (2013.01); *F25B 2700/21152* (2013.01)

(56) References Cited

U.S. PATENT DOCUMENTS

2003/0010047 A1 1/2003 Shimoda
2005/0194455 A1* 9/2005 Alles ..... F24F 3/0442 236/1 B
2007/0180851 A1* 8/2007 Fujiyoshi ..... F24F 3/1411 62/480
2009/0118870 A1* 5/2009 Matsui ..... F24F 3/14 700/278
2010/0218527 A1* 9/2010 Kitagishi ..... F24F 11/008 62/228.5
2010/0262299 A1* 10/2010 Cheung ..... G05D 23/1904 700/278
2011/0118857 A1* 5/2011 Bodnar ..... G05B 13/026 700/47
2012/0180508 A1* 7/2012 Endoh ..... F24D 11/0221 62/159
2013/0067944 A1* 3/2013 Kibo ..... F24F 11/008 62/157
2013/0319018 A1* 12/2013 Lim ..... F25B 49/022 62/56
2013/0338837 A1* 12/2013 Hublou ..... G05D 23/1923 700/278
2015/0276255 A1* 10/2015 Honda ..... F24F 11/008 62/216

FOREIGN PATENT DOCUMENTS

JP 2002-61925 A 2/2002
JP 2002-147823 A 5/2002
JP 2003-130522 A 5/2003

OTHER PUBLICATIONS

International Search Report of corresponding PCT Application No. PCT/JP2012/76932 dated Dec. 18, 2012.
International Preliminary Report of corresponding PCT Application No. PCT/JP2012/076932 dated Apr. 30, 2015.

* cited by examiner

AIR CONDITIONING APPARATUS

TECHNICAL FIELD

The present invention relates to an air conditioning apparatus and particularly an air conditioning apparatus equipped with a refrigerant circuit configured as a result of plural indoor units being connected to an outdoor unit.

BACKGROUND ART

Conventionally, there has been an air conditioning apparatus equipped with a refrigerant circuit configured as a result of plural indoor units being connected to an outdoor unit. As this air conditioning apparatus, there is an air conditioning apparatus that has a capacity controlling part that controls the air conditioning capacity of the outdoor unit (specifically, the operating capacity of the compressor) in such a way that the evaporation temperature or the condensation temperature of refrigerant in the refrigerant circuit becomes a target evaporation temperature or a target condensation temperature. Additionally, as an example of an air conditioning apparatus that has a capacity controlling part, there is the air conditioning apparatus described in JP-A No. 2002-147823, which is configured in such a way as to change the target evaporation temperature or the target condensation temperature. Here, the target evaporation temperature or the target condensation temperature is changed in accordance with the air conditioning load characteristics of a building.

SUMMARY

By changing the target evaporation temperature or the target condensation temperature as described above, an excess of the air conditioning capacity of the outdoor unit can be suppressed, the frequency with which the indoor units and the compressor alternate between being operated and being stopped can be reduced, and energy conservation can be improved. For this reason, the air conditioning apparatus easily satisfies users who prefer to conserve energy.

However, on the other hand, the amount of time it takes until the room temperatures of the air conditioned spaces reach set temperatures that are target values of the room temperatures tends to become longer in correspondence to the more the air conditioning capacity of the outdoor unit tends to be easily suppressed, and there is the concern that comfort will be compromised. For this reason, the air conditioning apparatus does not easily satisfy users who prefer comfort.

In this way, in the air conditioning apparatus, whether to give priority to energy conservation or whether to give priority to comfort differs depending on the preference of the user, so what is wanted is the provision of an air conditioning apparatus that can satisfy any user.

It is an object of the present invention to make it possible, in an air conditioning apparatus equipped with a refrigerant circuit configured as a result of plural indoor units being connected to an outdoor unit, for priority to be given to energy conservation or for priority to be given to comfort according to the preference of the user.

An air conditioning apparatus pertaining to a first aspect is an air conditioning apparatus equipped with a refrigerant circuit configured as a result of plural indoor units being connected to an outdoor unit, the air conditioning apparatus having a capacity controlling part and a target refrigerant temperature mode setting part. The capacity controlling part is a part that controls the air conditioning capacity of the outdoor unit in such a way that the evaporation temperature or the condensation temperature of refrigerant in the refrigerant circuit becomes a target evaporation temperature or a target condensation temperature. The target refrigerant temperature mode setting part is a part for setting a target refrigerant temperature mode to either of a target refrigerant temperature changing mode that changes the target evaporation temperature or the target condensation temperature and a target refrigerant temperature fixing mode that fixes the target evaporation temperature or the target condensation temperature. Here, "evaporation temperature" means a state quantity that is equivalent to the evaporation pressure in the refrigerant circuit, and "condensation temperature" means a state quantity that is equivalent to the condensation pressure in the refrigerant circuit. That is, "evaporation pressure" and "evaporation temperature", "target evaporation pressure" and "target evaporation temperature". "condensation pressure" and "condensation temperature", and "target condensation pressure" and "target condensation temperature" mean substantially the same state quantities even though the wordings themselves are different.

Here, the target refrigerant temperature mode can be set to either of the target refrigerant temperature changing mode and the target refrigerant temperature fixing mode by the target refrigerant temperature mode setting part. Additionally, when the target refrigerant temperature mode is set to the target refrigerant temperature changing mode, priority can be given to energy conservation, and when the target refrigerant temperature mode is set to the target refrigerant temperature fixing mode, priority can be given to comfort.

Because of this, here, priority can be given to energy conservation or priority can be given to comfort according to the preference of the user.

An air conditioning apparatus pertaining to a second aspect is the air conditioning apparatus pertaining to the first aspect, wherein the target refrigerant temperature changing mode has a fast changing mode and a slow changing mode. The fast changing mode is a mode that changes the target evaporation temperature or the target condensation temperature in such a way that room temperatures of air conditioned spaces targeted by the indoor units reach, in a short amount of time, set temperatures that are target values of the room temperatures. The slow changing mode is a mode that changes the target evaporation temperature or the target condensation temperature in such a way that the room temperatures reach the set temperatures in a longer amount of time than in the fast changing mode. Additionally, the fast changing mode and the slow changing mode are set by the target refrigerant temperature mode setting part.

Here, when the target refrigerant temperature mode is set to the target refrigerant temperature changing mode by the target refrigerant temperature mode setting part, the target refrigerant temperature mode can be set to either of two modes—the fast changing mode and the slow changing mode—in which the degree of control trackability is different. Additionally, when the target refrigerant temperature mode is set to the fast changing mode, control trackability is improved compared to a case where the target refrigerant temperature mode is set to the slow changing mode.

Because of this, here, by setting the target refrigerant temperature mode to the target refrigerant temperature changing mode, priority can be given to energy conservation, and at the same time the degree of control trackability can be changed according to the preference of the user.

An air conditioning apparatus pertaining to a third aspect is the air conditioning apparatus pertaining to the second aspect, wherein in the target refrigerant temperature fixing mode, the target evaporation temperature or the target condensation temperature is fixed to a maximum capacity evaporation temperature or a maximum capacity condensation temperature corresponding to a case where the air conditioning capacity of the outdoor unit is at 100% capacity.

Here, the target evaporation temperature or the target condensation temperature is constantly fixed to the maximum capacity evaporation temperature or the maximum capacity condensation temperature.

Because of this, here, air conditioning operations can be performed in a state in which priority is constantly given to comfort.

An air conditioning apparatus pertaining to a fourth aspect is the air conditioning apparatus pertaining to the third aspect, wherein the fast changing mode has a powerful mode and a quick mode. The powerful mode is a mode that allows the target evaporation temperature or the target condensation temperature to be changed to a lowest evaporation temperature or a highest condensation temperature exceeding the maximum capacity evaporation temperature or the maximum capacity condensation temperature. The quick mode is a mode that does not allow the target evaporation temperature or the target condensation temperature to be changed to the lowest evaporation temperature or the highest condensation temperature. Additionally, the powerful mode and the quick mode are set by the target refrigerant temperature mode setting part.

Here, when the target refrigerant temperature mode is set to the fast changing mode of the target refrigerant temperature changing mode by the target refrigerant temperature mode setting part, the target refrigerant temperature mode can be set to either of two modes—the powerful mode and the quick mode—in which the degree of control trackability is further different. Additionally, when the target refrigerant temperature mode is set to the powerful mode, the target evaporation temperature or the target condensation temperature is allowed to be changed to the lowest evaporation temperature or the highest condensation temperature exceeding the maximum capacity evaporation temperature or the maximum capacity condensation temperature, so control trackability is further improved compared to a case where the target refrigerant temperature mode is set to the quick mode.

Because of this, here, by setting the target refrigerant temperature mode to the fast changing mode, control trackability can be improved, and at the same time the degree of control trackability can be further changed according to the preference of the user.

An air conditioning apparatus pertaining to a fifth aspect is the air conditioning apparatus pertaining to any of the second to fourth aspects, wherein the target refrigerant temperature changing mode further has an automatic mode and a high-sensitivity mode. The automatic mode is a mode that sets a reference target evaporation temperature or a reference target condensation temperature serving as a reference value of the target evaporation temperature or the target condensation temperature in accordance with an outdoor temperature of an outside space where the outdoor unit is disposed. The high-sensitivity mode is a mode in which a user sets the reference target evaporation temperature or the reference target condensation temperature. Additionally, the fast changing mode and the slow changing mode are set, together with the automatic mode or the high-sensitivity mode, by the target refrigerant temperature mode setting part. The target evaporation temperature or the target condensation temperature is changed by making, with respect to the reference target evaporation temperature or the reference target condensation temperature, a correction corresponding to the fast changing mode or the slow changing mode.

Here, when the target refrigerant temperature mode is set to the target refrigerant temperature changing mode by the target refrigerant temperature mode setting part, the target refrigerant temperature mode can be set to either of two modes—the automatic mode and the high-sensitivity mode—in which the way of setting the reference target evaporation temperature or the reference target condensation temperature is different. Additionally, when the target refrigerant temperature mode is set to the automatic mode, the reference target evaporation temperature or the reference target condensation temperature is set in accordance with the outdoor temperature, so the target evaporation temperature or the target condensation temperature that is set as a result of a correction corresponding to the fast changing mode and the slow changing mode being made to the reference target evaporation temperature or the reference target condensation temperature can further improve the degree of energy conservation compared to a case where the target refrigerant temperature mode is set to the high-sensitivity mode. On the other hand, when the target refrigerant temperature mode is set to the high-sensitivity mode, the degree of energy conservation can be set according to the preference of the user.

Because of this, here, by setting the target refrigerant temperature mode to the target refrigerant temperature changing mode, priority can be given to energy conservation, and at the same time the degree of energy conservation can be changed according to the preference of the user.

An air conditioning apparatus pertaining to a sixth aspect is the air conditioning apparatus pertaining to the fifth aspect, wherein the target refrigerant temperature changing mode further has an economy mode. The economy mode is a mode in which the reference target evaporation temperature or the reference target condensation temperature that has been set in the automatic mode or the high-sensitivity mode is set as the target evaporation temperature or the target condensation temperature without a correction being made to that reference target evaporation temperature or that reference target condensation temperature. Additionally, the economy mode is set, together with the automatic mode or the high-sensitivity mode, by the target refrigerant temperature mode setting part.

Here, when the target refrigerant temperature mode is set to the automatic mode or the high-sensitivity mode of the target refrigerant temperature changing mode by the target refrigerant temperature mode setting part, the target refrigerant temperature mode can be set to any of three modes including, in addition to the fast changing mode and the slow changing mode, the economy mode in which the way of correcting the reference target evaporation temperature or the reference target condensation temperature that has been set in the automatic mode or the high-sensitivity mode is different. Additionally, when the target refrigerant temperature mode is set to the economy mode, the target evaporation temperature or the target condensation temperature is set without a correction being made to the reference target evaporation temperature or the reference target condensation temperature, so the degree of control trackability can be brought closest to the preference of the user.

Because of this, here, by setting the target refrigerant temperature mode to the automatic mode or the high-sensitivity mode, the degree of energy conservation can be set, and at the same time the degree of control trackability can be changed according to the preference of the user.

An air conditioning apparatus pertaining to a seventh aspect is the air conditioning apparatus pertaining to the fifth or sixth aspect, wherein the reference target evaporation temperature is restricted to be equal to or less than an upper limit evaporation temperature that has been set in accordance with the room temperatures.

The reference target evaporation temperature is set in accordance with the outdoor temperature in the automatic mode and is set by the user in the high-sensitivity mode, so in an operating state in which the outdoor temperature is high and the room temperatures are low, there can be cases where the humidity in the air conditioned spaces becomes higher than the relative humidity (usually about 60%) suitable for the room temperatures. When the relative humidity becomes higher, discomfort increases in the air conditioned spaces, so this kind of operating state needs to be avoided.

Therefore, here, the reference target evaporation temperature that is set in the automatic mode and the high-sensitivity mode is restricted to be equal to or less than the upper limit evaporation temperature that has been set in accordance with the room temperatures, so it is ensured that the humidity in the air conditioned spaces becomes equal to or less than the relative humidity suitable for the room temperatures.

Because of this, here, discomfort in the air conditioned spaces can be suppressed, and at the same time the degree of energy conservation and the degree of control trackability can be changed according to the preference of the user.

DESCRIPTION OF EMBODIMENT

An embodiment of an air conditioning apparatus pertaining to the present invention will be described below on the basis of the drawings. The specific configurations of the embodiment of the air conditioning apparatus pertaining to the present invention are not limited to the following embodiment and its example modifications and can be changed without departing from the spirit of the invention.

(1) Basic Configuration of Air Conditioning Apparatus

Figure 1:
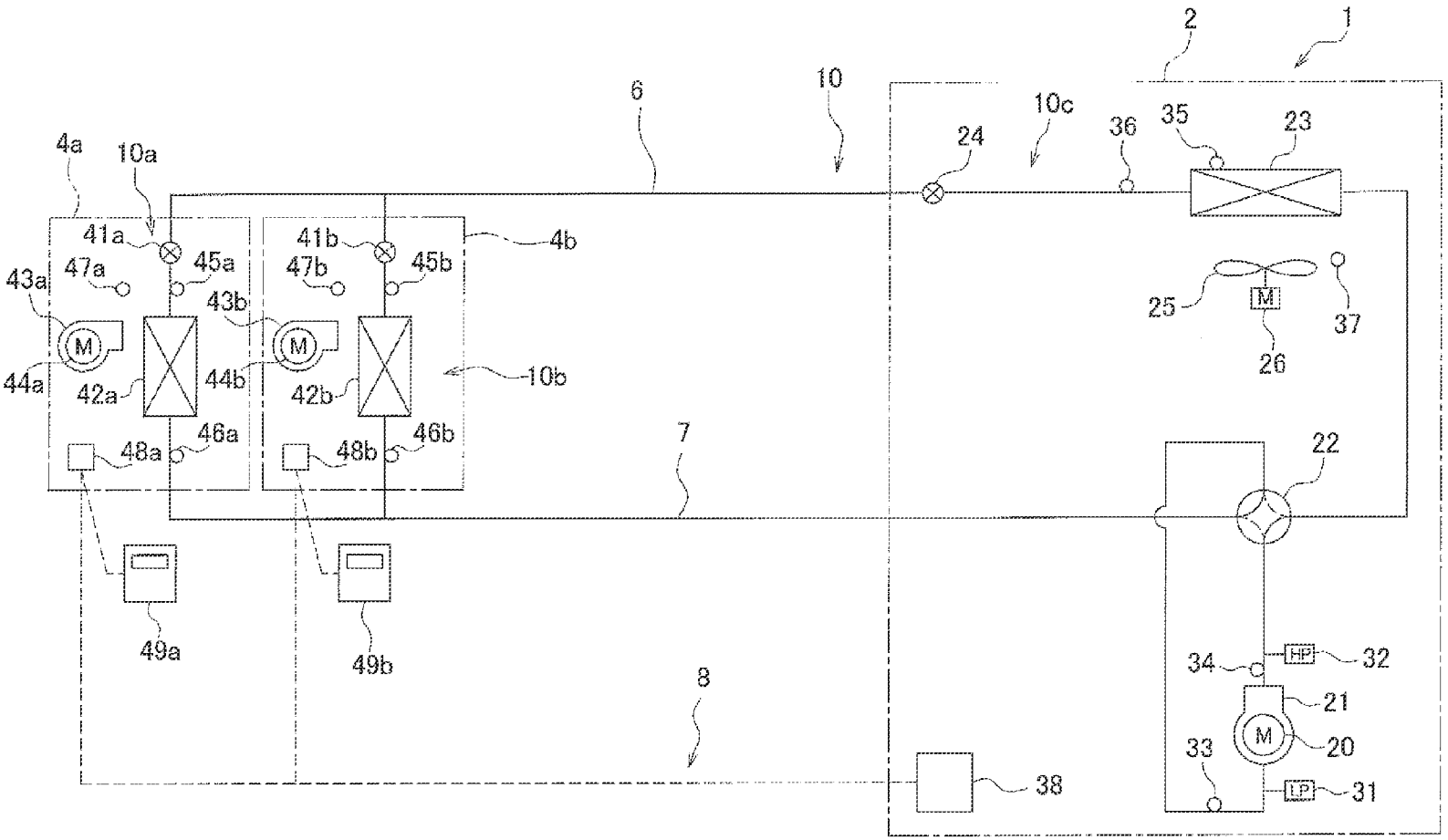
FIG. 1 is a schematic configuration diagram of an air conditioning apparatus pertaining to an embodiment of the present invention.

FIG. 1 is a schematic configuration diagram of an air conditioning apparatus 1 pertaining to an embodiment of the present invention. The air conditioning apparatus 1 is a apparatus used to air condition the inside of a building or the like by performing a vapor compression refrigeration cycle operation. The air conditioning apparatus 1 is mainly configured as a result of an outdoor unit 2 and plural (here, two) indoor units 4*a* and 4*b* being connected to one another. Here, the outdoor unit 2 and the plural indoor units 4*a* and 4*b* are connected to one another via a liquid refrigerant connection pipe 6 and a gas refrigerant connection pipe 7. That is, a vapor compression refrigerant circuit 10 of the air conditioning apparatus 1 is configured as a result of the outdoor unit 2 and the plural indoor units 4*a* and 4*b* being connected to one another via the refrigerant connection pipes 6 and 7.

<Indoor Units>

The indoor units 4*a* and 4*b* are installed indoors. The indoor units 4*a* and 4*b* are connected to the outdoor unit 2 via the refrigerant connection pipes 6 and 7 and configure part of the refrigerant circuit 10.

Next, the configuration of the indoor units 4*a* and 4*b* will be described. The indoor unit 4*b* has the same configuration as the indoor unit 4*a*, so here just the configuration of the indoor unit 4*a* will be described; regarding the configuration of the indoor unit 4*b*, the letter "b" will be added instead of the letter "a" indicating each part of the indoor unit 4*a*, and description of each part of the indoor unit 4*b* will be omitted.

The indoor unit 4*a* mainly has an indoor-side refrigerant circuit 10*a* (an indoor-side refrigerant circuit 10*b* in the indoor unit 4*b*) that configures part of the refrigerant circuit 10. The indoor-side refrigerant circuit 10*a* mainly has an indoor expansion valve 41*a* and an indoor heat exchanger 42*a*.

The indoor expansion valve 41*a* is a valve that reduces the pressure of refrigerant flowing through the indoor-side refrigerant circuit 10*a* to thereby adjust the flow rate of the refrigerant. The indoor expansion valve 41*a* is an electrically powered expansion valve connected to the liquid side of the indoor heat exchanger 42*a*.

The indoor heat exchanger 42*a* comprises a cross-fin type fin and tube heat exchanger, for example. In the neighborhood of the indoor heat exchanger 42*a*, there is disposed an indoor fan 43*a* for delivering room air to the indoor heat exchanger 42*a*. Heat exchange takes place between the refrigerant and the room air in the indoor heat exchanger 42*a* as a result of the indoor fan 43*a* delivering the room air to the indoor heat exchanger 42*a*. The indoor fan 43*a* is driven to rotate by an indoor fan motor 44*a*. Because of this, the indoor heat exchanger 42*a* functions as a radiator of the refrigerant and an evaporator of the refrigerant.

Furthermore, various sensors are disposed in the indoor unit 4*a*. On the liquid side of the indoor heat exchanger 42*a*, there is disposed a liquid-side temperature sensor 45*a* that detects a temperature Trla of the refrigerant in a liquid state or a gas-liquid two-phase state. On the gas side of the indoor heat exchanger 42*a*, there is disposed a gas-side temperature sensor 46*a* that detects a temperature Trga of the refrigerant in a gas state. On the room air inlet side of the indoor unit 4*a*, there is disposed a room temperature sensor 47*a* that detects the temperature of the room air (i.e., a room temperature Tra) in the air conditioned space targeted by the indoor unit 4*a*. Furthermore, the indoor unit 4*a* has an indoor-side control unit 48*a* that controls the actions of each part configuring the indoor unit 4*a*. Additionally, the indoor-side control unit 48*a* has a microcomputer, which is disposed in order to control the indoor unit 4*a*, and a memory and the like, and the indoor-side control unit 48*a* can exchange control signals and so forth with a remote controller 49*a* for individually operating the indoor unit 4*a* and can exchange control signals and so forth with the outdoor unit 2. The remote controller 49*a* is a device for a user to make various settings relating to air conditioning operations and issue operate/stop commands.

<Outdoor Unit>

The outdoor unit 2 is installed outdoors. The outdoor unit 2 is connected to the indoor units 4*a* and 4*b* via the refrigerant connection pipes 6 and 7 and configures part of the refrigerant circuit 10.

Next, the configuration of the outdoor unit 2 will be described.

The outdoor unit 2 mainly has an outdoor-side refrigerant circuit 10*c* that configures part of the refrigerant circuit 10. The outdoor-side refrigerant circuit 10*c* mainly has a compressor 21, a switching mechanism 22, an outdoor heat exchanger 23, and an outdoor expansion valve 24.

The compressor 21 is a closed compressor having a casing inside of which are housed a non-illustrated compression element and a compressor motor 20 that drives the compression element to rotate. The compressor motor 20 is supplied with electrical power via a non-illustrated inverter device, and its operating capacity can be changed by changing the frequency (i.e., the rotational speed) of the inverter device.

The switching mechanism 22 is a four-way switching valve for switching the direction of the flow of the refrigerant. During a cooling operation, which is one of the air conditioning operations, the switching mechanism 22 can interconnect the discharge side of the compressor 21 and the gas side of the outdoor heat exchanger 23 and also interconnect the suction side of the compressor 21 and the gas refrigerant connection pipe 7 in order to cause the outdoor heat exchanger 23 to function as a radiator of the refrigerant that has been compressed in the compressor 21 and cause the indoor heat exchangers 42*a* and 42*b* to function as evaporators of the refrigerant that has radiated heat in the outdoor heat exchanger 23 (a radiation switching state; see the solid lines of the switching mechanism 22 in FIG. 1), and during a heating operation, which is one of the air conditioning operations, the switching mechanism 22 can interconnect the discharge side of the compressor 21 and the gas refrigerant connection pipe 7 and also interconnect the suction side of the compressor 21 and the gas side of the outdoor heat exchanger 23 in order to cause the indoor heat exchangers 42*a* and 42*b* to function as radiators of the refrigerant that has been compressed in the compressor 21 and cause the outdoor heat exchanger 23 to function as an evaporator of the refrigerant that has radiated heat in the indoor heat exchangers 42*a* and 42*b* (an evaporation switching state; see the dashed lines of the switching mechanism 22 in FIG. 1). The switching mechanism 22 does not have to be a four-way switching valve and may also be a mechanism configured by combining a three-way valve and an electromagnetic valve and the like to fulfill the same functions.

The outdoor heat exchanger 23 comprises a cross-fin type fin and tube heat exchanger, for example. In the neighborhood of the outdoor heat exchanger 23, there is disposed an outdoor fan 25 for delivering outdoor air to the outdoor heat exchanger 23. Heat exchange takes place between the refrigerant and the outdoor air in the outdoor heat exchanger 23 as a result of the outdoor fan 25 delivering the outdoor air to the outdoor heat exchanger 23. The outdoor fan 25 is driven to rotate by an outdoor fan motor 26. Because of this, the outdoor heat exchanger 23 functions as a radiator of the refrigerant and an evaporator of the refrigerant.

The outdoor expansion valve 24 is a valve that reduces the pressure of the refrigerant flowing through the outdoor-side refrigerant circuit 10*c*. The outdoor expansion valve 24 is an electrically powered expansion valve connected to the liquid side of the outdoor heat exchanger 23.

Furthermore, various sensors are disposed in the outdoor unit 2. In the outdoor unit 2, there are disposed a suction pressure sensor 31 that detects a suction pressure Ps of the compressor 21, a discharge pressure sensor 32 that detects a discharge pressure Pd of the compressor 21, a suction temperature sensor 33 that detects a suction temperature Ts of the compressor 21, and a discharge temperature sensor 34 that detects a discharge temperature Td of the compressor 21. In the outdoor heat exchanger 23, there is disposed an outdoor heat exchange temperature sensor 35 that detects a temperature Tol1 of the refrigerant in a gas-liquid two-phase state. On the liquid side of the outdoor heat exchanger 23, there is disposed a liquid-side temperature sensor 36 that detects a temperature Tol2 of the refrigerant in a liquid state or a gas-liquid two-phase state. On the outdoor air inlet side of the outdoor unit 2, there is disposed an outdoor temperature sensor 37 that detects the temperature of the outdoor air (i.e., an outdoor temperature Ta) in the outside space where the outdoor unit 2 is disposed. Furthermore, the outdoor unit 2 has an outdoor-side control unit 38 that controls the actions of each part configuring the outdoor unit 2. Additionally, the outdoor-side control unit 38 has a microcomputer, which is disposed in order to control the outdoor unit 2, a memory, and an inverter device and the like that controls the compressor motor 20, and the outdoor-side control unit 38 can exchange control signals and so forth with the indoor-side control units 48*a* and 48*b* of the indoor units 4*a* and 4*b*.

<Refrigerant Connection Pipes>

The refrigerant connection pipes 6 and 7 are refrigerant pipes installed on site when installing the air conditioning apparatus 1, and pipes having various lengths and pipe diameters depending on the installation conditions of the outdoor unit 2 and the indoor units 4*a* and 4*b* are used.

<Control Unit>

Figure 2:
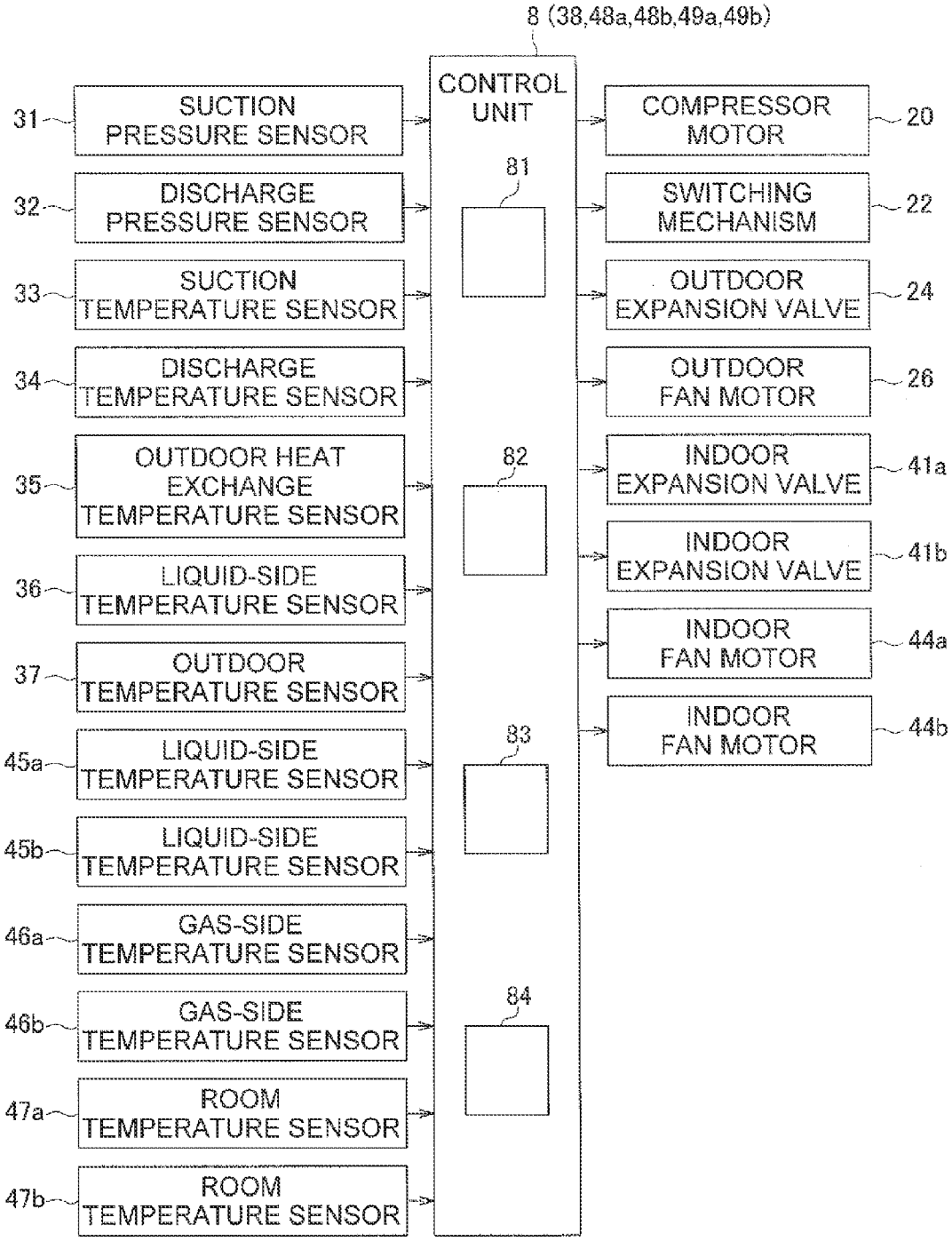
FIG. 2 is a control block diagram of the air conditioning apparatus.

As shown in FIG. 1, the remote controllers 49*a* and 49*b* for individually operating the indoor units 4*a* and 4*b*, the indoor-side control units 48*a* and 48*b* of the indoor units 4*a* and 4*b*, and the outdoor-side control unit 38 of the outdoor unit 2 configure a control unit 8 that controls the operations of the entire air conditioning apparatus 1. As shown in FIG. 2, the control unit 8 is connected in such a way that it can receive detection signals of the various sensors 31 to 37, 45*a*, 45*b*, 46*a*, 46*b*, 47*a*, and 47*b* and so forth. Additionally, the control unit 8 is configured in such a way that it can perform the air conditioning operations (the cooling operation and the heating operation) by controlling the various devices and valves 20, 22, 24, 26, 41*a*, 41*b*, 44*a*, and 44*b* on the basis of these detection signals and so forth. Furthermore, here, the control unit 8 mainly has a capacity controlling part 81, an indoor controlling part 82, a target refrigerant temperature mode setting part 83, and a target refrigerant temperature changing part 84. The capacity controlling part 81 is a part that controls the air conditioning capacity of the outdoor unit 2 in such a way that an evaporation temperature Te or a condensation temperature Tc of the refrigerant in the refrigerant circuit 10 becomes a target evaporation temperature Tes or a target condensation temperature Tcs. The indoor controlling part 82 is a part that controls the devices and valves 41*a*, 41*b*, 44*a*, and 44*b* of the indoor units 4*a* and 4*b* in such a way that the room temperatures Tra and Trb of the air conditioned spaces targeted by the indoor units 4*a* and 4*b* become set temperatures Tras and Trbs that are target values of the room temperatures Tra and Trb. The target refrigerant temperature mode setting part 83 is a part for setting modes relating to the target evaporation temperature Tes and the target condensation temperature Tcs, such as setting whether to change or fix the target evaporation temperature Tes or the target condensation temperature Tcs. The target refrigerant temperature changing part 84 is a part for changing or fixing the target evaporation temperature Tes and the target condensation temperature Tcs in accordance with the mode that has been set by the target refrigerant temperature mode setting part 83. Here, FIG. 2 is a control block diagram of the air conditioning apparatus 1.

As described above, the air conditioning apparatus 1 has the refrigerant circuit 10 that is configured as a result of the plural (here, two) indoor units 4*a* and 4*b* being connected to the outdoor unit 2. Additionally, in the air conditioning apparatus 1, the following air conditioning operations and control are performed by the control unit 8.

(2) Basic Actions of Air Conditioning Apparatus

Next, the basic actions of the air conditioning operations (the cooling operation and the heating operation) of the air conditioning apparatus 1 will be described using FIG. 1.

<Cooling Operation>

When a cooling operation command is given from the remote controllers 49*a* and 49*b*, the switching mechanism 22 is switched to a radiation operating state (the state indicated by the solid lines of the switching mechanism 22 in FIG. 1), and the compressor 21, the outdoor fan 25, and the indoor fans 43*a* and 43*b* start up.

Then, the low-pressure gas refrigerant in the refrigerant circuit 10 is sucked into the compressor 21, is compressed, and becomes high-pressure gas refrigerant. The high-pressure gas refrigerant is sent via the switching mechanism 22 to the outdoor heat exchanger 23. The high-pressure gas refrigerant that has been sent to the outdoor heat exchanger 23 condenses and becomes high-pressure liquid refrigerant as a result of exchanging heat with the outdoor air supplied by the outdoor fan 25 and being cooled in the outdoor heat exchanger 23 functioning as a radiator of the refrigerant. The high-pressure liquid refrigerant is sent via the outdoor expansion valve 24 and the liquid refrigerant connection pipe 6 from the outdoor unit 2 to the indoor units 4*a* and 4*b*.

The high-pressure liquid refrigerant that has been sent to the indoor units 4*a* and 4*b* has its pressure reduced by the indoor expansion valves 41*a* and 41*b* and becomes low-pressure refrigerant in a gas-liquid two-phase state. The low-pressure refrigerant in the gas-liquid two-phase state is sent to the indoor heat exchangers 42*a* and 42*b*. The low-pressure refrigerant in the gas-liquid two-phase state that has been sent to the indoor heat exchangers 42*a* and 42*b* evaporates and becomes low-pressure gas refrigerant as a result of exchanging heat with the room air supplied by the indoor fans 43*a* and 43*b* and being heated in the indoor heat exchangers 42*a* and 42*b* functioning as evaporators of the refrigerant. The low-pressure gas refrigerant is sent via the gas refrigerant connection pipe 7 from the indoor units 4*a* and 4*b* to the outdoor unit 2.

The low-pressure gas refrigerant that has been sent to the outdoor unit 2 is sucked via the switching mechanism 22 back into the compressor 21.

<Heating Operation>

When a heating operation command is given from the remote controllers 49*a* and 49*b*, the switching mechanism 22 is switched to an evaporation operating state (the state indicated by the dashed lines of the switching mechanism 22 in FIG. 1), and the compressor 21, the outdoor fan 25, and the indoor fans 43*a* and 43*b* start up.

Then, the low-pressure gas refrigerant in the refrigerant circuit 10 is sucked into the compressor 21, is compressed, and becomes high-pressure gas refrigerant. The high-pressure gas refrigerant is sent via the switching mechanism 22 and the gas refrigerant connection pipe 7 from the outdoor unit 2 to the indoor units 4*a* and 4*b*.

The high-pressure gas refrigerant that has been sent to the indoor units 4*a* and 4*b* is sent to the indoor heat exchangers 42*a* and 42*b*. The high-pressure gas refrigerant that has been sent to the indoor heat exchangers 42*a* and 42*b* condenses and becomes high-pressure liquid refrigerant as a result of exchanging heat with the room air supplied by the indoor fans 43*a* and 43*b* and being cooled in the indoor heat exchangers 42*a* and 42*b* functioning as radiators of the refrigerant. The high-pressure liquid refrigerant has its pressure reduced by the indoor expansion valves 41*a* and 41*b*. The refrigerant whose pressure has been reduced by the indoor expansion valves 41*a* and 41*b* is sent via the liquid refrigerant connection pipe 6 from the indoor units 4*a* and 4*b* to the outdoor unit 2.

The refrigerant that has been sent to the outdoor unit 2 is sent to the outdoor expansion valve 24, has its pressure reduced by the outdoor expansion valve 24, and becomes low-pressure refrigerant in a gas-liquid two-phase state. The low-pressure refrigerant in the gas-liquid two-phase state is sent to the outdoor heat exchanger 23. The low-pressure refrigerant in the gas-liquid two-phase state that has been sent to the outdoor heat exchanger 23 evaporates and becomes low-pressure gas refrigerant as a result of exchanging heat with the outdoor air supplied by the outdoor fan 25 and being heated in the outdoor heat exchanger 23 functioning as an evaporator of the refrigerant. The low-pressure gas refrigerant is sucked via the switching mechanism 22 back into the compressor 21.

<Basic Control>

In the air conditioning operations (the cooling operation and the heating operation) described above, the air conditioning capacity of the outdoor unit 2 is controlled in such a way that the evaporation temperature Te or the condensation temperature Tc of the refrigerant in the refrigerant circuit 10 becomes the target evaporation temperature Tes or the target condensation temperature Tcs. Furthermore, the devices and valves 41*a*, 41*b*, 44*a*, and 44*b* of the indoor units 4*a* and 4*b* are controlled in such a way that the room temperatures Tra and Trb associated with the indoor units 4*a* and 4*b* become the set temperatures Tras and Trbs of the room temperatures associated with the indoor units 4*a* and 4*b*. The setting of the set temperatures Tras and Trbs of the room temperatures associated with the indoor units 4*a* and 4*b* is performed by the remote controllers 49*a* and 49*b*. Furthermore, the control of the outdoor unit 2 is performed by the capacity controlling part 81, which is configured by the outdoor-side control unit 38 of the control unit 8, and the control of the indoor units 4*a* and 4*b* is performed by the indoor controlling part 82, which is configured by the indoor-side control units 48*a* and 48*b* of the control unit 8.

—During Cooling Operation—

In a case where the air conditioning operation is the cooling operation, the indoor controlling part 82 of the control unit 8 controls the opening degrees of the indoor expansion valves 41*a* and 41*b* in such a way that degrees of superheating SHra and SHrb of the refrigerant in the outlets of the indoor heat exchangers 42*a* and 42*b* become target degrees of superheating SHras and SHrbs (hereinafter this control will be called "degree of superheating control by indoor expansion valves"). Here, the degrees of superheating SHra and SHrb are calculated from the suction pressure Ps detected by the suction pressure sensor 31 and the temperatures Trga and Trgb of the refrigerant on the gas sides of the indoor heat exchangers 42*a* and 42*b* detected by the gas-side temperature sensors 46*a* and 46*b*. More specifically, first, the suction pressure Ps is converted into the saturation temperature of the refrigerant to obtain the evaporation temperature Te, which is a state quantity that is equivalent to the evaporation pressure Pe in the refrigerant circuit 10. Here, "evaporation pressure Pe" means a pressure representing the low-pressure refrigerant flowing from the outlets of the indoor expansion valves 41*a* and 41*b* via the indoor heat exchangers 42*a* and 42*b* to the suction side of the compressor 21 during the cooling operation. Additionally, the degrees of superheating SHra and SHrb are obtained by subtracting the evaporation temperature Te from the temperatures Trga and Trgb of the refrigerant on the gas sides of the indoor heat exchangers 42*a* and 42*b*.

Furthermore, in a case where the air conditioning operation is the cooling operation, the capacity controlling part 81 of the control unit 8 controls the operating capacity of the compressor 21 in such a way that the evaporation temperature Te corresponding to the evaporation pressure Pe in the refrigerant circuit 10 becomes closer to the target evaporation temperature Tes (hereinafter this control will be called "evaporation temperature control by compressor"). Here, the control of the operating capacity of the compressor 21 is performed by changing the frequency of the compressor motor 20. Furthermore, here, the evaporation temperature Te is used as the state quantity that is controlled, but the state quantity that is controlled may also be the evaporation pressure Pe. In this case, it suffices to use a target evaporation pressure Pes corresponding to the target evaporation temperature Tes. That is, "evaporation pressure Pe" and "evaporation temperature Te", and "target evaporation pressure Pes" and "target evaporation temperature Tes", mean substantially the same state quantities even though the wordings themselves are different.

In this way, in the cooling operation, the degree of superheating control by the indoor expansion valves 41*a* and 41*b* and the evaporation temperature control by the compressor 21 are performed as the basic control. Additionally, in the air conditioning apparatus 1, it is ensured by this basic control of the cooling operation that the room temperatures Tra and Trb associated with the indoor units 4*a* and 4*b* become the set temperatures Tras and Trbs of the room temperatures associated with the indoor units 4*a* and 4*b*.

—During Heating Operation—

In a case where the air conditioning operation is the heating operation, the indoor controlling part 82 of the control unit 8 controls the opening degrees of the indoor expansion valves 41*a* and 41*b* in such a way that degrees of subcooling SCra and SCrb of the refrigerant in the outlets of the indoor heat exchangers 42*a* and 42*b* become target degrees of subcooling SCras and SCrbs (hereinafter this control will be called "degree of subcooling control by indoor expansion valves"). Here, the degrees of subcooling SCra and SCrb are calculated from the discharge pressure Pd detected by the discharge pressure sensor 32 and the temperatures Trla and Trlb of the refrigerant on the liquid sides of the indoor heat exchangers 42*a* and 42*b* detected by the liquid-side temperature sensors 45*a* and 45*b*. More specifically, first, the discharge pressure Pd is converted into the saturation temperature of the refrigerant to obtain the condensation temperature Tc, which is a state quantity that is equivalent to the condensation pressure Pc in the refrigerant circuit 10. Here, "condensation pressure Pc" means a pressure representing the high-pressure refrigerant flowing from the discharge side of the compressor 21 via the indoor heat exchangers 42*a* and 42*b* to the indoor expansion valves 41*a* and 41*b* during the heating operation. Additionally, the degrees of subcooling SCra and SCrb are obtained by subtracting the temperatures Trla and Trlb of the refrigerant on the liquid sides of the indoor heat exchangers 42*a* and 42*b* from the condensation temperature Tc.

Furthermore, in a case where the air conditioning operation is the heating operation, the capacity controlling part 81 of the control unit 8 controls the operating capacity of the compressor 21 in such a way that the condensation temperature Tc corresponding to the condensation pressure Pc in the refrigerant circuit 10 becomes closer to the target condensation temperature Tcs (hereinafter this control will be called "condensation temperature control by compressor"). Here, the control of the operating capacity of the compressor 21 is performed by changing the frequency of the compressor motor 20. Furthermore, here, the condensation temperature Tc is used as the state quantity that is controlled, but the state quantity that is controlled may also be the condensation pressure Pc. In this case, it suffices to use a target condensation pressure Pcs corresponding to the target condensation temperature Tcs. That is, "condensation pressure Pc" and "condensation temperature Tc", and "target condensation pressure Pcs" and "target condensation temperature Tcs", mean substantially the same state quantities even though the wordings themselves are different.

In this way, in the heating operation, the degree of subcooling control by the indoor expansion valves 41*a* and 41*b* and the condensation temperature control by the compressor 21 are performed as the basic control. Additionally, in the air conditioning apparatus 1, it is ensured by this basic control of the heating operation that the room temperatures Tra and Trb associated with the indoor units 4*a* and 4*b* become the set temperatures Tras and Trbs of the room temperatures associated with the indoor units 4*a* and 4*b*.

—Thermostat Control—

When the room temperatures Tra and Trb associated with the indoor units 4*a* and 4*b* reach the set temperatures Tras and Trbs of the room temperatures associated with the indoor units 4*a* and 4*b* because of the basic control of the air conditioning operations (the cooling operation and the heating operation) described above, the following thermostat control is performed.

The thermostat control means setting a thermostat temperature range with respect to the set temperatures Tras and Trbs of the indoor units 4*a* and 4*b* and performing indoor thermostat OFF, indoor thermostat ON, outdoor thermostat OFF, and outdoor thermostat ON. Here, "indoor thermostat OFF" means suspending, in a case where the room temperature associated with an indoor unit performing an air conditioning operation has become the set temperature, the air conditioning operation of the corresponding indoor unit. That is, the indoor expansion valve of the corresponding indoor unit is closed to ensure that the refrigerant does not flow to the indoor heat exchanger. "Indoor thermostat ON" means resuming, in a case where the room temperature associated with an indoor unit in an indoor thermostat OFF state has deviated from the thermostat temperature range, the air conditioning operation of the corresponding indoor unit. That is, the indoor expansion valve of the corresponding indoor unit is opened (i.e., the degree of superheating control or the degree of subcooling control by the indoor expansion valve is performed) to ensure that the refrigerant flows to the indoor heat exchanger. "Outdoor thermostat OFF" means stopping the compressor 21 in a case where all the indoor units performing an air conditioning operation have switched to an indoor thermostat OFF state. Because of this, the flow of the refrigerant in the refrigerant circuit 10 stops, and the air conditioning apparatus 1 switches to a state in which the air conditioning operations are all substantially stopped even though an air conditioning operation command is being given. "Outdoor thermostat ON" means restarting the compressor 21 in a case where, in the outdoor thermostat OFF state, at least one indoor unit has switched to an indoor thermostat ON state. Because of this, the refrigerant flows in the refrigerant circuit 10, and the air conditioning apparatus 1 switches to a state in which the air conditioning operations are resumed. Here, "indoor thermostat OFF" and "indoor thermostat ON" are performed by the indoor controlling part 82 of the control unit 8, and "outdoor thermostat OFF" and "outdoor thermostat ON" are performed by the capacity controlling part 81 of the control unit 8.

(3) Target Refrigerant Temperature Mode Setting and Actions in Each Mode

When the air conditioning apparatus 1 performs the air conditioning operations (the cooling operation and the heating operation) accompanied by the thermostat control described above, the room temperatures Tra and Trb associated with the indoor units 4*a* and 4*b* are controlled in such a way as to become the set temperatures Tras and Trbs of the room temperatures associated with the indoor units 4*a* and 4*b*.

Here, it is conceivable to configure the air conditioning apparatus to change the target evaporation temperature Tes and the target condensation temperature Tcs in accordance with the air conditioning load characteristics of the building, like in patent document 1. That is, it is conceivable for the air conditioning apparatus to lower, during the cooling operation, the target evaporation temperature Tes the larger the temperature difference is between the set temperatures Tras and Trbs and the outdoor temperature Ta and to raise, during the heating operation, the target condensation temperature Tcs the larger the temperature difference is between the set temperatures Tras and Trbs and the outdoor temperature Ta. Additionally, when the air conditioning apparatus changes the target evaporation temperature Tes or the target condensation temperature Tcs in this way, in a case where the air conditioning capacity requirement from the indoor units 4*a* and 4*b* is small, the target evaporation temperature Tes becomes higher and the target condensation temperature Tcs becomes lower, so an excess of the air conditioning capacity of the outdoor unit 2 is suppressed. Because of this, the frequency with which the indoor units 4*a* and 4*b* and the compressor 21 alternate between being operated and being stopped—that is, indoor thermostat ON/indoor thermostat OFF, outdoor thermostat ON/outdoor thermostat OFF—can be reduced so that energy conservation can be improved.

However, on the other hand, the amount of time it takes until the room temperatures Tra and Trb of the air conditioned spaces to reach the set temperatures Tras and Trbs tends to become longer in correspondence to the more the air conditioning capacity of the outdoor unit 2 tends to be easily suppressed, and there is the concern that comfort will be compromised.

In this way, simply changing the target evaporation temperature Tes or the target condensation temperature Tcs in accordance with the air conditioning load characteristics of the building will not necessarily satisfy all users, because although users who prefer to conserve energy will be satisfied, users who prefer comfort will not be easily satisfied.

Therefore, here, in order to make it possible for priority to be given to energy conservation or for priority to be given to comfort according to the preference of the user, as shown in FIG. 2, the control unit 8 is disposed with the target refrigerant temperature mode setting part 83 for setting modes relating to the target evaporation temperature Tes or the target condensation temperature Tcs, such as setting whether to change or fix the target evaporation temperature Tes and the target condensation temperature Tcs. Here, the target refrigerant temperature mode setting part 83 is a memory disposed in the outdoor-side control unit 38 of the control unit 8 and can set the target refrigerant temperature mode to various modes relating to the target evaporation temperature Tes or the target condensation temperature Tcs by communication from an external device for performing various control settings of the air conditioning apparatus 1. The target refrigerant temperature mode setting part 83 is not limited to the part described above, and it suffices for the target refrigerant temperature mode setting part 83 to be a part that can set the target refrigerant temperature mode to various modes relating to the target evaporation temperature Tes and the target condensation temperature Tcs, such as, for example, a DIP switch disposed in the outdoor-side control unit 38.

Figure 3:
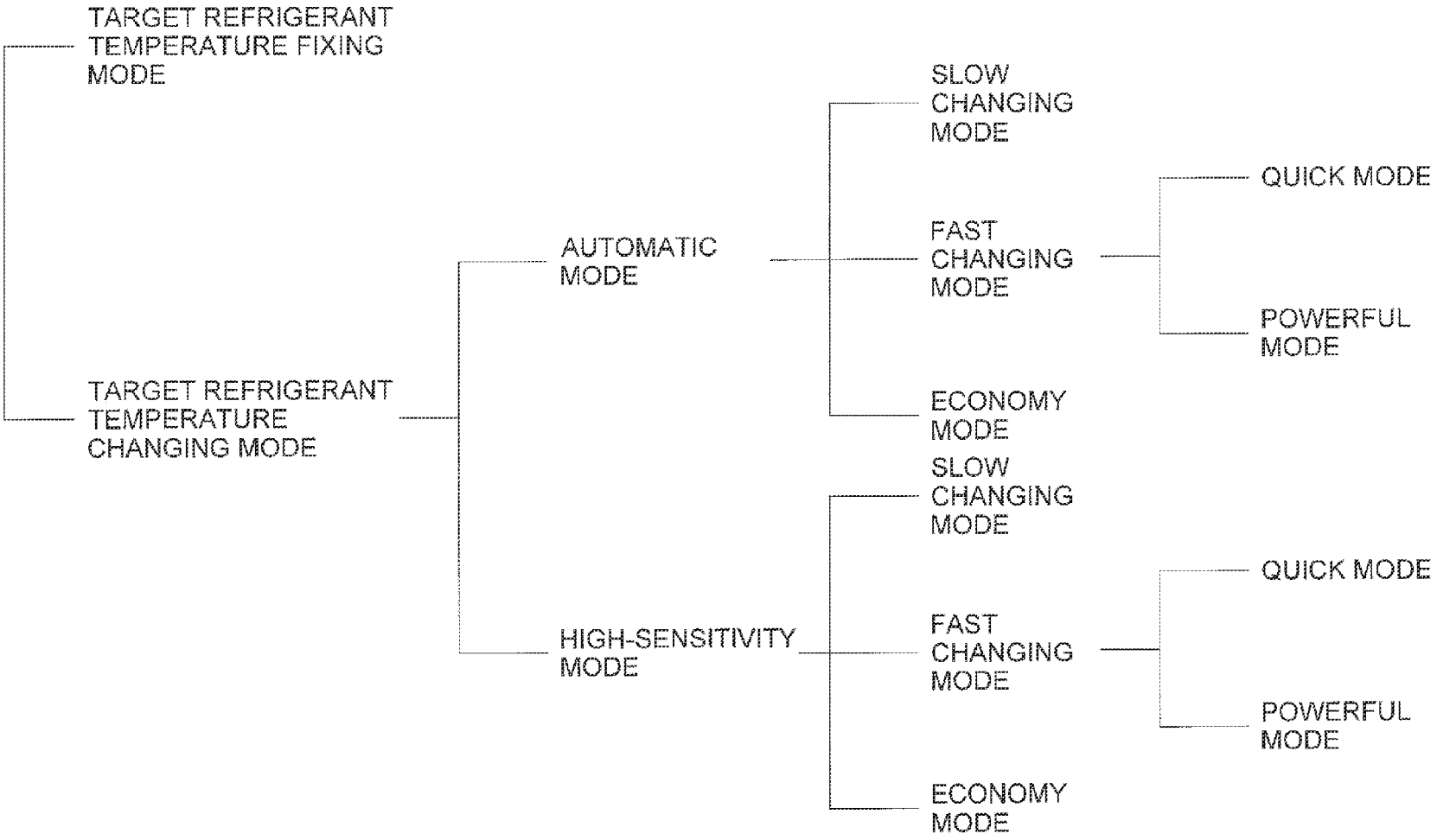
FIG. 3 is a drawing showing various modes relating to a target evaporation temperature and a target condensation temperature that are settable.
Figure 4:
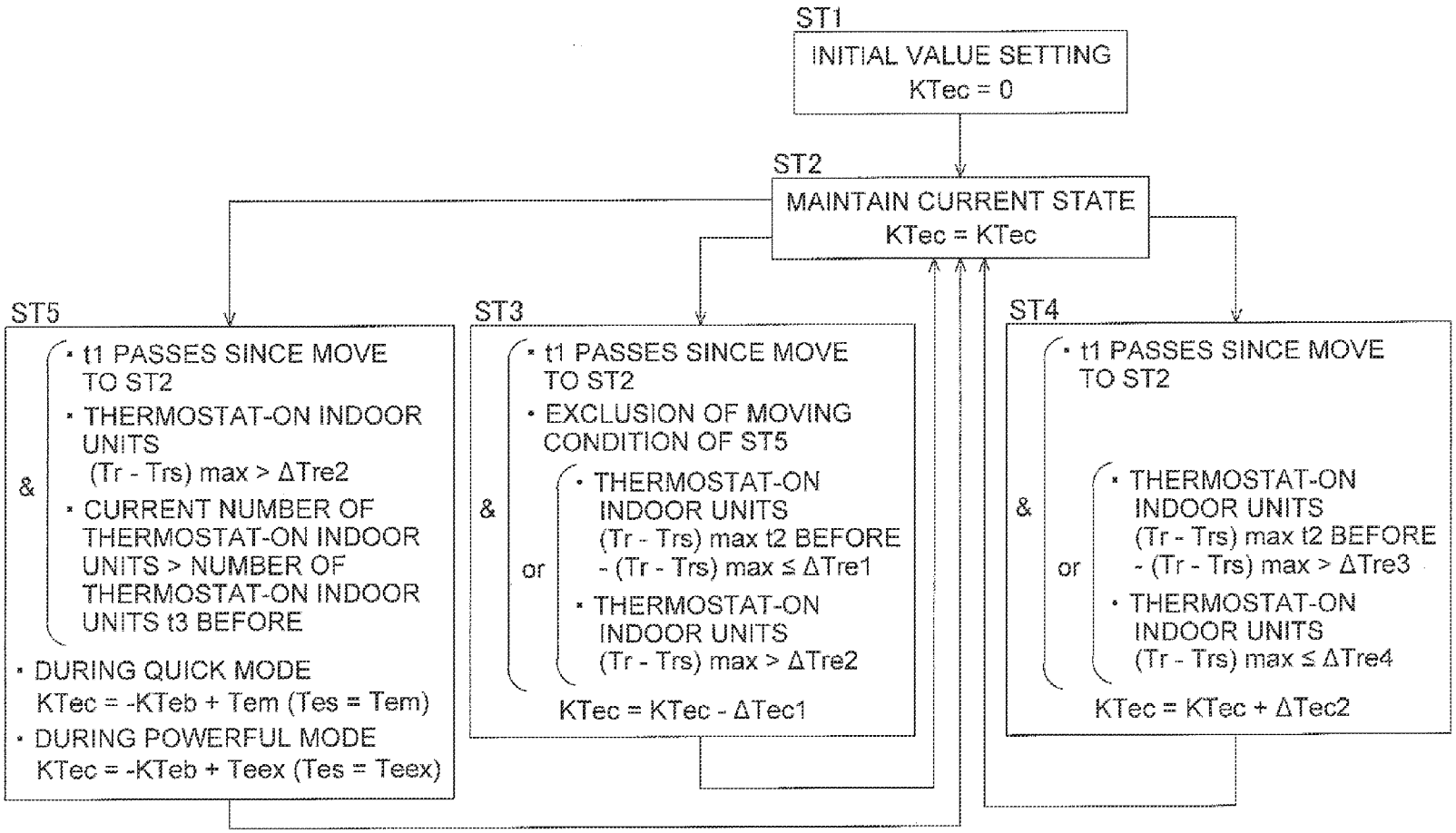
FIG. 4 is a flowchart showing control for correcting the target evaporation temperature in a slow changing mode and a fast changing mode (a quick mode and a powerful mode)
Figure 5:
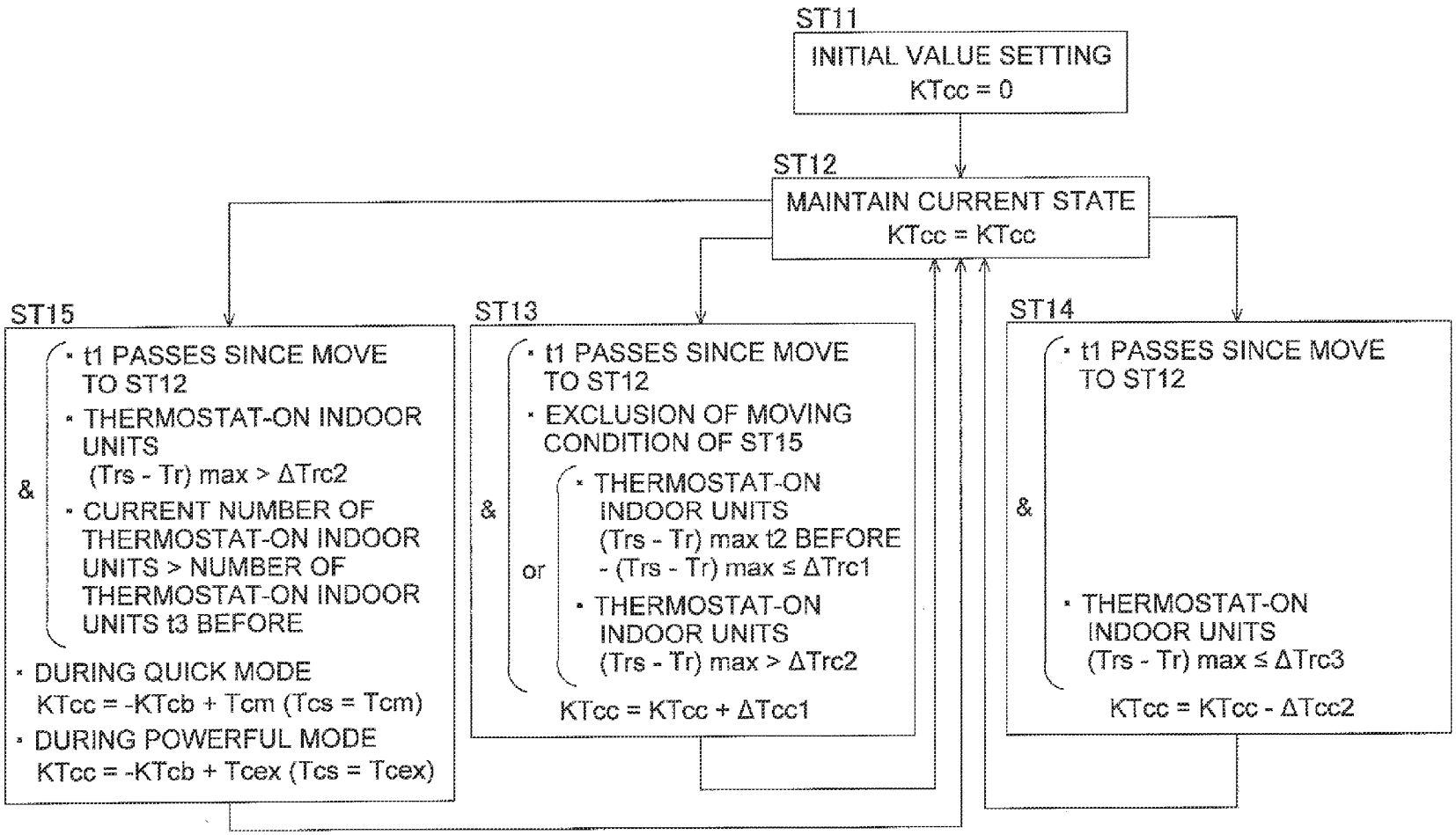
FIG. 5 is a flowchart showing control for correcting the target condensation temperature in the slow changing mode and the fast changing mode (the quick mode and the powerful mode)
Figure 6:
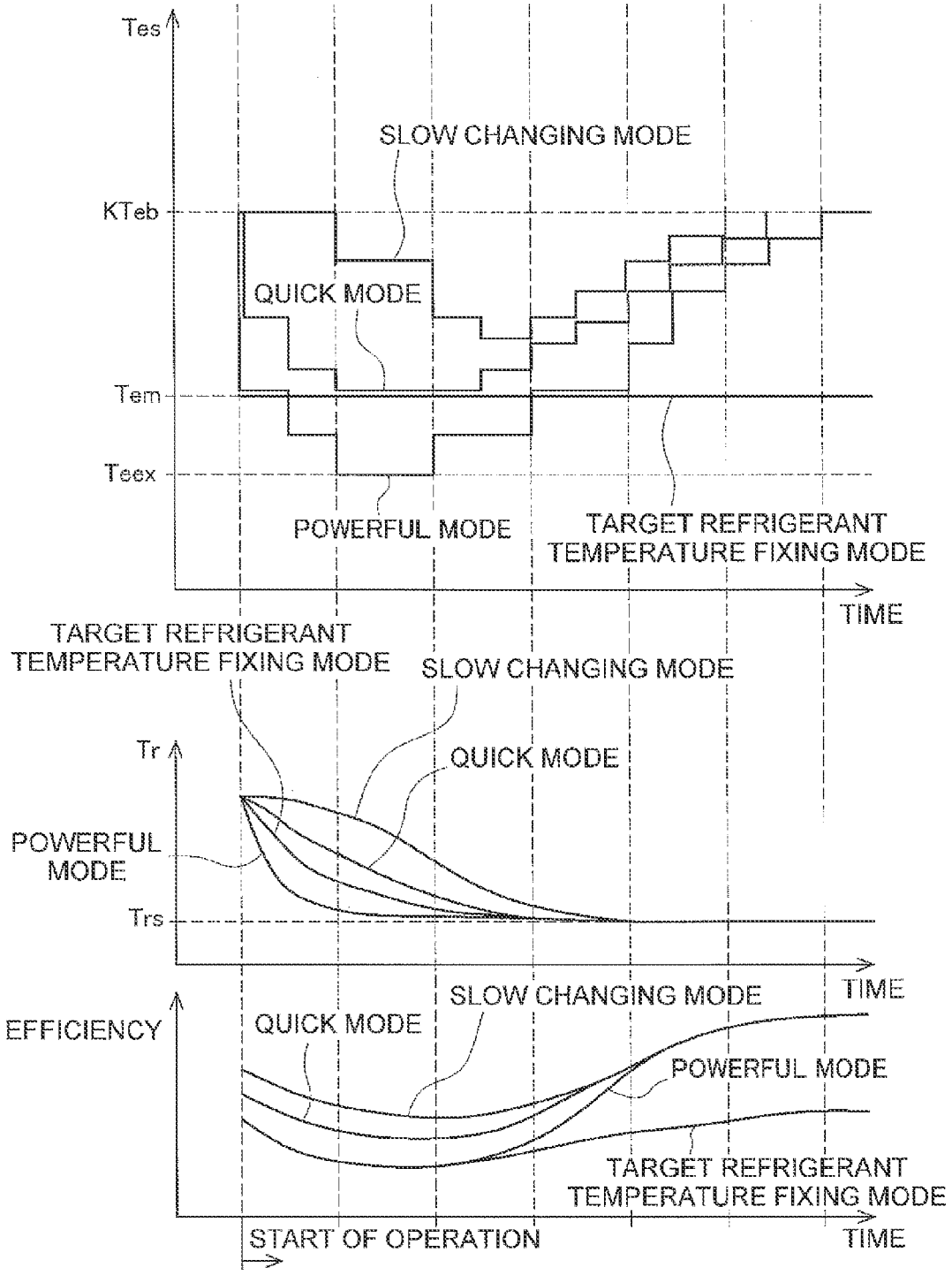
FIG. 6 is a drawing showing temporal changes, from the start of a cooling operation, in the target evaporation temperature, room temperatures, and efficiency in a target refrigerant temperature fixing mode and a target refrigerant temperature changing mode (the slow changing mode, the quick mode, and the powerful mode)
Figure 7:
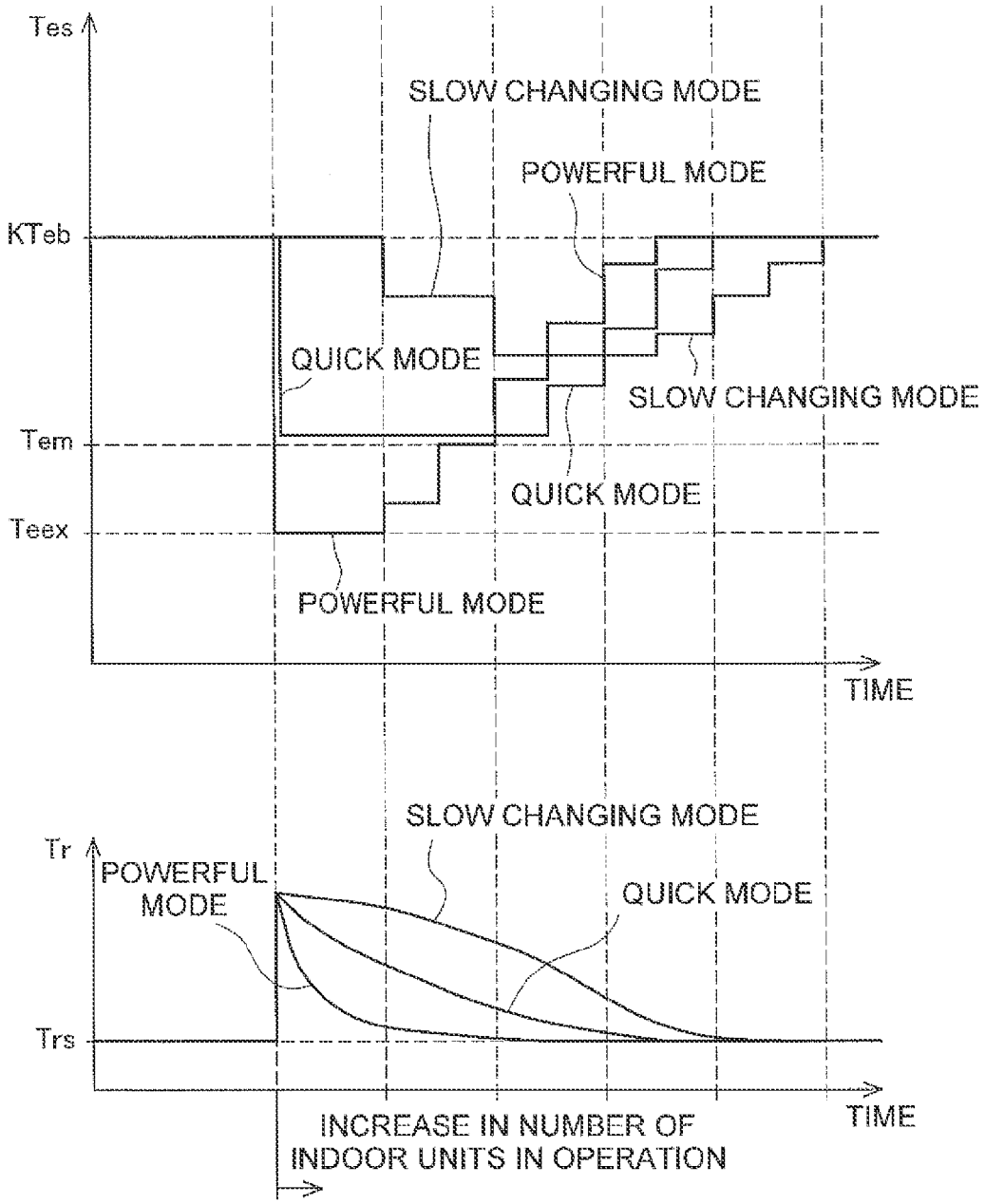
FIG. 7 is a drawing showing temporal changes in the target evaporation temperature and the room temperatures in the slow changing mode, the quick mode, and the powerful mode in a case where the number of indoor units in operation has increased during the cooling operation.
Figure 8:
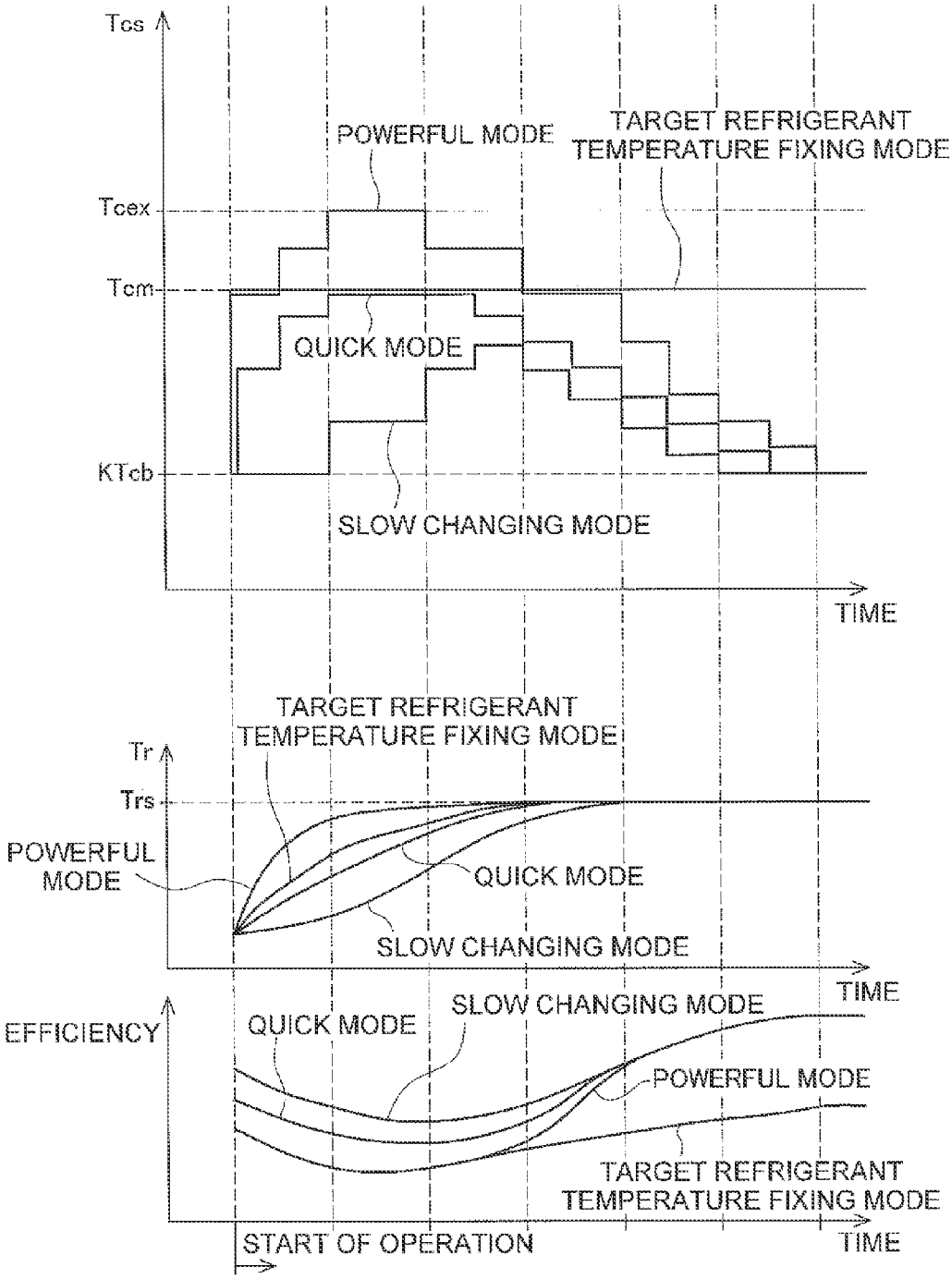
FIG. 8 is a drawing showing temporal changes, from the start of a heating operation, in the target condensation temperature, the room temperatures, and efficiency in the target refrigerant temperature fixing mode and the target refrigerant temperature changing mode (the slow changing mode, the quick mode, and the powerful mode)
Figure 9:
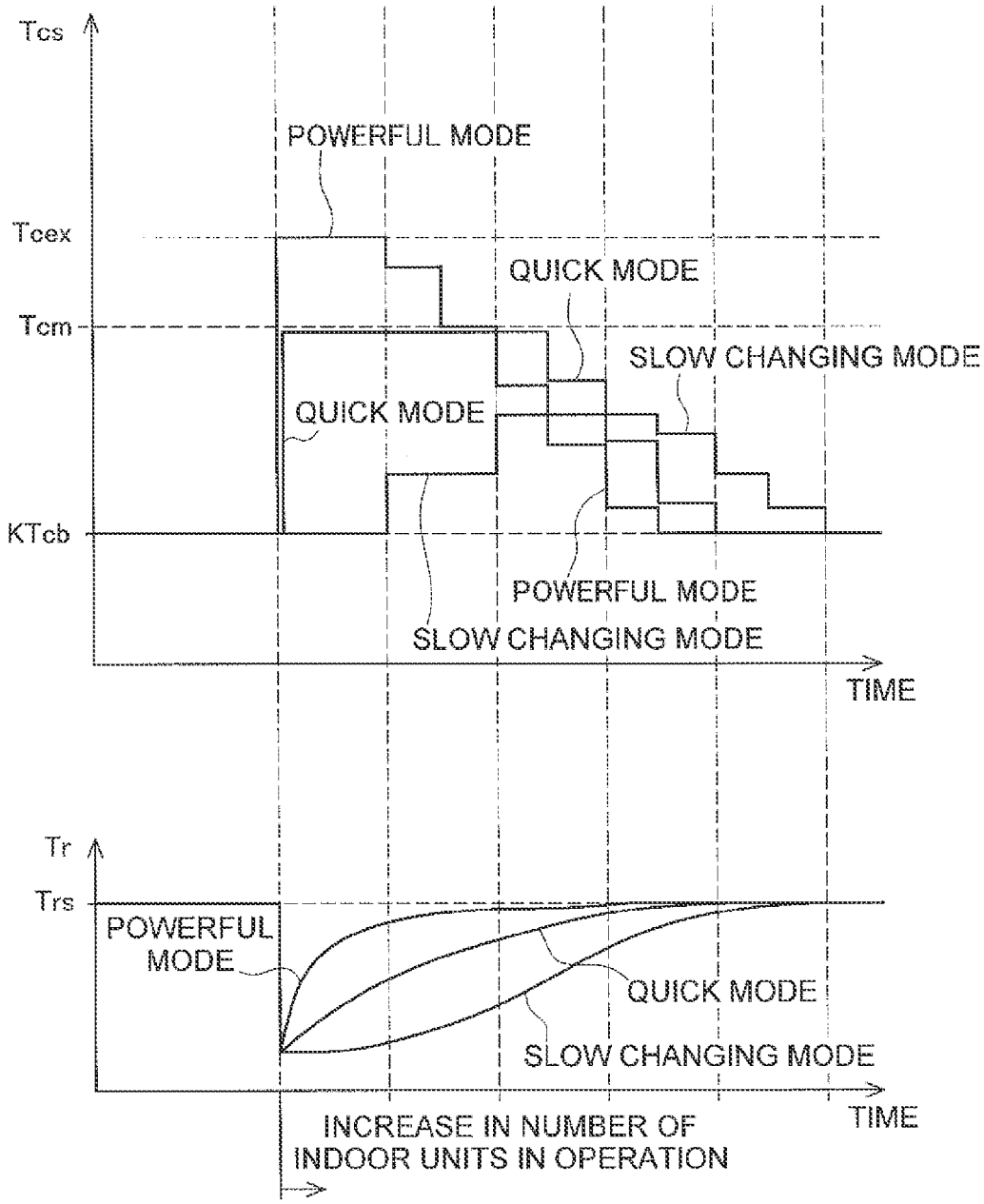
FIG. 9 is a drawing showing temporal changes in the target condensation temperature and the room temperatures in the slow changing mode, the quick mode, and the powerful mode in a case where the number of indoor units in operation has increased during the heating operation.

Next, the various modes relating to the target evaporation temperature Tes and the target condensation temperature Tcs that are settable by the target refrigerant temperature mode setting part 83 and the actions in each mode will be described using FIG. 3 to FIG. 9. Here, FIG. 3 is a drawing showing the various modes relating to the target evaporation temperature Tes and the target condensation temperature Tcs that are settable. FIG. 4 is a flowchart showing control for correcting the target evaporation temperature Tes in a fast changing mode (or first changing mode) and a slow changing mode (or second changing mode). The fast changing mode includes a powerful mode (or first sub-mode and a quick mode (or second sub-mode). FIG. 5 is a flowchart showing control for correcting the target condensation temperature Tcs in the slow changing mode and the fast changing mode (the quick mode and the powerful mode). FIG. 6 is a drawing showing temporal changes, from the start of the cooling operation, in the target evaporation temperature Tes, room temperatures Tr, and efficiency in a target refrigerant temperature fixing mode and a target refrigerant temperature changing mode (the slow changing mode, the quick mode, and the powerful mode). FIG. 7 is a drawing showing temporal changes in the target evaporation temperature Tes and the room temperatures Tr in the slow changing mode, the quick mode, and the powerful mode in a case where the number of indoor units in operation has increased during the cooling operation. FIG. 8 is a drawing showing temporal changes, from the start of the heating operation, in the target condensation temperature Tcs, the room temperatures Tr, and efficiency in the target refrigerant temperature fixing mode and the target refrigerant temperature changing mode (the slow changing mode, the quick mode, and the powerful mode). FIG. 9 is a drawing showing temporal changes in the target condensation temperature Tcs and the room temperatures Tr in the slow changing mode, the quick mode, and the powerful mode in a case where the number of indoor units in operation has increased during the heating operation.

<Target Refrigerant Temperature Fixing Mode>

First, as a mode relating to the target evaporation temperature Tes and the target condensation temperature Tcs that is settable by the target refrigerant temperature mode setting part 83, as shown in FIG. 3, there is a target refrigerant temperature fixing mode that fixes the target evaporation temperature Tes or the target condensation temperature Tcs. When the mode is set to the target refrigerant temperature fixing mode, the target evaporation temperature Tes in the cooling operation is fixed to a predetermined value and the target condensation temperature Tcs in the heating operation is fixed to a predetermined value.

Here, as shown in FIG. 2, the control unit 8 is disposed with the target refrigerant temperature changing part 84 serving as a part for changing or fixing the target evaporation temperature Tes and the target condensation temperature Tcs in accordance with the mode that has been set by the target refrigerant temperature mode setting part 83. For this reason, when the mode is set to the target refrigerant temperature fixing mode by the target refrigerant temperature mode setting part 83, the target refrigerant temperature changing part 84 fixes the target evaporation temperature Tes in the cooling operation to the predetermined value and fixes the target condensation temperature Tcs in the heating operation to the predetermined value.

Here, the target evaporation temperature Tes is fixed to a maximum capacity evaporation temperature Tem (e.g., 6° C.) corresponding to a case where the air conditioning (cooling) capacity of the outdoor unit 2 is at 100% capacity. Furthermore, the target condensation temperature Tcs is fixed to a maximum capacity condensation temperature Tcm (e.g., 46° C.) corresponding to a case where the air conditioning (heating) capacity of the outdoor unit 2 is at 100% capacity.

In the target refrigerant temperature fixing mode, the target evaporation temperature Tes or the target condensation temperature Tcs is constantly fixed to the maximum capacity evaporation temperature Tem or the maximum capacity condensation temperature Tcm.

Because of this, in a case where the mode is set to the target refrigerant temperature fixing mode, as shown in FIG. 6 and FIG. 8, the air conditioning operations can be performed in a state in which priority is constantly given to comfort. However, it becomes easy for efficiency to drop because it is easy for the air conditioning capacity of the outdoor unit 2 to become excessive.

<Target Refrigerant Temperature Changing Mode>

Next, as a mode relating to the target evaporation temperature Tes and the target condensation temperature Tcs that is settable by the target refrigerant temperature mode setting part 83, as shown in FIG. 3, there is a target refrigerant temperature changing mode that changes the target evaporation temperature Tes or the target condensation temperature Tcs. When the mode is set to the target refrigerant temperature changing mode, the target evaporation temperature Tes is changed as a result of a reference target evaporation temperature KTeb serving as a reference value of the target evaporation temperature Tes in the cooling operation being set automatically or by the user and an evaporation temperature correction value KTec being added to the reference target evaporation temperature KTeb. That is, the target evaporation temperature Tes can be expressed by the equation Tes=KTeb+KTec. Furthermore, in the heating operation, the target condensation temperature Tcs is changed as a result of a reference target condensation temperature KTcb serving as a reference value of the target condensation temperature Tcs being set automatically or by the user and a condensation temperature correction value KTcc being added to the reference target condensation temperature KTcb. That is, the target condensation temperature Tcs can be expressed by the equation Tcs=KTcb+KTcc.

Here, as shown in FIG. 3, the target refrigerant temperature changing mode has two modes (a fast changing mode and a slow changing mode) in which the degree of control trackability is different. Additionally, the fast changing mode and the slow changing mode are set by the target refrigerant temperature mode setting part 83. Furthermore, as shown in FIG. 3, the fast changing mode has two modes (a powerful mode and a quick mode) in which the degree of control trackability is further different. Additionally, the powerful mode and the quick mode are set by the target refrigerant temperature mode setting part 83. Furthermore, the target refrigerant temperature changing mode has two modes, i.e., an automatic mode and a high-sensitivity mode (or user-set mode), in which the way of setting the reference target evaporation temperature KTeb or the reference target condensation temperature KTcb is different. Additionally, the automatic mode or the high-sensitivity mode is set, together with the fast changing mode and the slow changing mode, by the target refrigerant temperature mode setting part 83. Moreover, as shown in FIG. 3, the target refrigerant temperature changing mode has an economy mode in which the reference target evaporation temperature KTeb or the reference target condensation temperature KTcb that has been set in the high-sensitivity mode is set as the target evaporation temperature Tes or the target condensation temperature Tcs without a correction being made to that reference target evaporation temperature KTeb or that reference target condensation temperature KTcb. Additionally, the economy mode is set, together with the automatic mode or the high-sensitivity mode, by the target refrigerant temperature mode setting part 83.

In this way, here, the mode can be set to either of the target refrigerant temperature changing mode and the target refrigerant temperature fixing mode by the target refrigerant temperature mode setting part 83. Additionally, when the mode is set to the target refrigerant temperature changing mode, priority can be given to energy conservation as described below, and when the mode is set to the target refrigerant temperature fixing mode, priority can be given to comfort as described above. Because of this, here, priority can be given to energy conservation or priority can be given to comfort according to the preference of the user.

—Automatic Mode—

In the automatic mode, the reference target evaporation temperature KTeb or the reference target condensation temperature KTcb is set in accordance with the outdoor temperature Ta of the outside space where the outdoor unit 2 is disposed. Specifically, when the mode is set to the automatic mode by the target refrigerant temperature mode setting part 83, the reference target evaporation temperature KTeb or the reference target condensation temperature KTcb is set on the basis of a function of the outdoor temperature Ta. In the cooling operation, more air conditioning (cooling) capacity tends to be required the higher the outdoor temperature Ta is, so the reference target evaporation temperature KTeb is set on the basis of a function in which the reference target evaporation temperature KTeb becomes lower as the outdoor temperature Ta becomes higher. Furthermore, in the heating operation, more air conditioning (heating) capacity tends to be required the lower the outdoor temperature Ta is, so the reference target condensation temperature KTcb is set on the basis of a function in which the reference target condensation temperature KTcb becomes higher as the outdoor temperature Ta becomes lower. For this reason, when the mode is set to the automatic mode by the target refrigerant temperature mode setting part 83, the target refrigerant temperature changing part 84 automatically sets the reference target evaporation temperature KTeb in the cooling operation to a temperature value obtained on the basis of the above-described function and the outdoor temperature Ta and automatically sets the reference target condensation temperature KTcb in the heating operation to a temperature value obtained on the basis of the above-described function and the outdoor temperature Ta.

Additionally, in the automatic mode, during the cooling operation and the heating operation, the target refrigerant temperature changing part 84 changes the target evaporation temperature Tes and the target condensation temperature Tcs by changing the reference target evaporation temperature KTeb and the reference target condensation temperature KTcb in accordance with the outdoor temperature Ta and at the same time further making a correction according to the slow changing mode and the fast changing mode described below.

(Slow Changing Mode)

When the mode is set to the automatic mode and is set to the slow changing mode by the target refrigerant temperature mode setting part 83, during the cooling operation, the evaporation temperature correction value KTec is changed as shown in steps ST1 to ST4 of FIG. 4. Additionally, the target evaporation temperature Tes is changed by making a correction that adds the evaporation temperature correction value KTec to the reference target evaporation temperature KTeb. The changing of the evaporation temperature correction value KTec in the slow changing mode and the control that corrects the target evaporation temperature Tes by adding the evaporation temperature correction value KTec to the reference target evaporation temperature KTeb are performed by the target refrigerant temperature changing part 84.

Specifically, at the time when the cooling operation is started, first, in step ST1, an initial value setting of the evaporation temperature correction value KTec is performed. Here, the evaporation temperature correction value KTec=0, and so because of this, the target evaporation temperature Tes=the reference target evaporation temperature KTeb. Because of this, the cooling operation is started using the reference target evaporation temperature KTeb as the target evaporation temperature Tes.

Then, after performing processing that maintains the current state in step ST2, the target refrigerant temperature changing part 84 moves to the processing of step ST3 or step ST4.

In step ST3, assuming that a first amount of waiting time t1 (e.g., 10 minutes) has passed since the move to step ST2 and that a moving condition of step ST5 described later has not been met, the target refrigerant temperature changing part 84 performs slow changing control that changes the target evaporation temperature Tes in accordance with the temperature differences (Tr−Trs) between the room temperatures Tra and Trb (hereinafter called "the room temperatures Tr" by omitting the letters "a" and "b") of the air conditioned spaces targeted by the indoor units 4*a* and 4*b* and the set temperatures Tras and Trbs (hereinafter called "the set temperatures Trs" by omitting the letters "a" and "b") that are target values of the room temperatures Tr. Here, in a case where the target refrigerant temperature changing part 84 has determined that the temperature differences (Tr−Trs) meet the condition that it is necessary to lower the target evaporation temperature Tes, the target refrigerant temperature changing part 84 reduces the evaporation temperature correction value KTec by subtracting a correction value ΔTec1 (e.g., 0.5° C.) from the current evaporation temperature correction value KTec and adds the evaporation temperature correction value KTec to the reference target evaporation temperature KTeb to thereby correct the target evaporation temperature Tes in such a way that the target evaporation temperature Tes becomes lower.

Here, as a condition of the temperature differences (Tr−Trs), in a case where, compared to (Tr−Trs)max that is a maximum of the temperature differences (Tr−Trs) among the indoor units in an indoor thermostat ON state, (Tr−Trs)max an amount of time t2 (e.g., 5 minutes) before is equal to or less than a predetermined temperature difference ΔTre1 (e.g., 0.2° C.), the target refrigerant temperature changing part 84 performs slow changing control that corrects the target evaporation temperature Tes in such a way that the target evaporation temperature Tes becomes lower. That is, in a case where a large change cannot be seen in the room temperatures Tr, the target refrigerant temperature changing part 84 determines that the temperature differences (Tr−Trs) meet the condition that it is necessary to lower the target evaporation temperature Tes. Furthermore, as a condition of the temperature differences (Tr−Trs), also in a case where (Tr−Trs)max that is a maximum of the temperature differences (Tr−Trs) among the indoor units in an indoor thermostat ON state is larger than a predetermined temperature difference ΔTre2 (e.g., 3° C.), the target refrigerant temperature changing part 84 performs slow changing control that corrects the target evaporation temperature Tes in such a way that the target evaporation temperature Tes becomes lower. That is, in a case where the room temperatures Tr are higher than the set temperatures Trs, the target refrigerant temperature changing part 84 determines that the temperature differences (Tr−Trs) meet the condition that it is necessary to lower the target evaporation temperature Tes.

In step ST4, assuming that the first amount of waiting time t1 (e.g., 10 minutes) has passed since the move to step ST2, the target refrigerant temperature changing part 84 performs slow changing control that changes the target evaporation temperature Tes in accordance with the temperature differences (Tr−Trs) between the room temperatures Tr of the air conditioned spaces targeted by the indoor units 4*a* and 4*b* and the set temperatures Trs that are target values of the room temperatures Tr. Here, in a case where the target refrigerant temperature changing part 84 has determined that the temperature differences (Tr−Trs) meet the condition that it is necessary to raise the target evaporation temperature Tes, the target refrigerant temperature changing part 84 increases the evaporation temperature correction value KTec by adding a correction value ΔTec2 (e.g., 1° C.) to the current evaporation temperature correction value KTec and adds the evaporation temperature correction value KTec to the reference target evaporation temperature KTeb to thereby correct the target evaporation temperature Tes in such a way that the target evaporation temperature Tes becomes higher.

Here, as a condition of the temperature differences (Tr−Trs), in a case where, compared to (Tr−Trs)max that is a maximum of the temperature differences (Tr−Trs) among the indoor units in an indoor thermostat ON state, (Tr−Trs)max the amount of time t2 (e.g., 5 minutes) before is larger than a predetermined temperature difference ΔTre3 (e.g., 0.5° C.), the target refrigerant temperature changing part 84 performs slow changing control that corrects the target evaporation temperature Tes in such a way that the target evaporation temperature Tes becomes higher. That is, in a case where the room temperatures Tr are tending to become lower, the target refrigerant temperature changing part 84 determines that the temperature differences (Tr−Trs) meet the condition that it is necessary to raise the target evaporation temperature Tes. Furthermore, as a condition of the temperature differences (Tr−Trs), also in a case where (Tr−Trs)max that is a maximum of the temperature differences (Tr−Trs) among the indoor units in an indoor thermostat ON state is equal to or less than a predetermined temperature difference ΔTre4 (e.g., 0.5° C.), the target refrigerant temperature changing part 84 performs slow changing control that corrects the target evaporation temperature Tes in such a way that the target evaporation temperature Tes becomes higher. That is, in a case where the room temperatures Tr are in the vicinity of or lower than the set temperatures Trs, the target refrigerant temperature changing part 84 determines that the temperature differences (Tr−Trs) meet the condition that it is necessary to raise the target evaporation temperature Tes.

Then, after performing the processing of step ST3 or step ST4, the target refrigerant temperature changing part 84 returns to the processing of step ST2, and thereafter the processing of steps ST2, ST3, and ST4 is repeated.

Because of this slow changing mode, that is to say the slow changing control resulting from steps ST2, ST3, and ST4 during the cooling operation, the target evaporation temperature Tes is slowly changed as shown in FIG. 6. For this reason, an excess of the air conditioning (cooling) capacity of the outdoor unit 2 can be suppressed, efficiency is more easily improved, and energy conservation can be improved.

Moreover, here, the reference target evaporation temperature KTeb is set in accordance with the outdoor temperature Ta by the automatic mode, so the target evaporation temperature Tes that is set as a result of a correction corresponding to the slow changing mode being made to the reference target evaporation temperature KTeb can further improve the degree of energy conservation.

Moreover, here, the maximum value of the temperature differences between the room temperatures Tr and the set temperatures Trs among the indoor units in operation (in an indoor thermostat ON state) is used as a condition for changing the target evaporation temperature Tes. For this reason, the target evaporation temperature Tes is changed in accordance with the indoor unit in which the largest air conditioning (cooling) capacity is required. Because of this, here, the target evaporation temperature Tes can be promptly changed and control trackability can be improved.

Furthermore, when the mode is set to the automatic mode and is set to the slow changing mode by the target refrigerant temperature mode setting part 83, during the heating operation, the condensation temperature correction value KTcc is changed as shown in steps ST11 to ST14 of FIG. 5. Additionally, the target condensation temperature Tcs is changed by making a correction that adds the condensation temperature correction value KTcc to the reference target condensation temperature KTcb. The changing of the condensation temperature correction value KTcc and the control that corrects the target condensation temperature Tcs by adding the condensation temperature correction value KTcc to the reference target condensation temperature KTcb are performed by the target refrigerant temperature changing part 84.

Specifically, at the time when the heating operation is started, first, in step ST11, an initial value setting of the condensation temperature correction value KTcc is performed. Here, the condensation temperature correction value KTcc=0, and so because of this, the target condensation temperature Tcs=the reference target condensation temperature KTcb. Because of this, the heating operation is started using the reference target condensation temperature KTcb as the target condensation temperature Tcs.

Then, after performing processing that maintains the current state in step ST12, the target refrigerant temperature changing part 84 moves to the processing of step ST13 or step ST14.

In step ST13, assuming that a first amount of waiting time t1 (e.g., 10 minutes) has passed since the move to step ST12 and that a moving condition of step ST15 described later has not been met, the target refrigerant temperature changing part 84 performs slow changing control that changes the target condensation temperature Tcs in accordance with the temperature differences (Trs−Tr) between the room temperatures Tr of the air conditioned spaces targeted by the indoor units 4*a* and 4*b* and the set temperatures Trs that are target values of the room temperatures Tr. Here, in a case where the target refrigerant temperature changing part 84 has determined that the temperature differences (Trs−Tr) meet the condition that it is necessary to raise the target condensation temperature Tcs, the target refrigerant temperature changing part 84 increases the condensation temperature correction value KTcc by adding a correction value ΔTcc1 (e.g., 1° C.) to the current condensation temperature correction value KTcc and adds the condensation temperature correction value KTcc to the reference target condensation temperature KTcb to thereby correct the target condensation temperature Tcs in such a way that the target condensation temperature Tcs becomes higher.

Here, as a condition of the temperature differences (Trs−Tr), in a case where, compared to (Trs−Tr)max that is a maximum of the temperature differences (Trs−Tr) among the indoor units in an indoor thermostat ON state, (Trs−Tr)max an amount of time t2 (e.g., 5 minutes) before is equal to or less than a predetermined temperature difference ΔTrc1 (e.g., 0.2° C.), the target refrigerant temperature changing part 84 performs slow changing control that corrects the target condensation temperature Tcs in such a way that the target condensation temperature Tcs becomes higher. That is, in a case where a large change cannot be seen in the room temperatures Tr, the target refrigerant temperature changing part 84 determines that the temperature differences (Trs−Tr) meet the condition that it is necessary to raise the target condensation temperature Tcs. Furthermore, as a condition of the temperature differences (Trs−Tr), also in a case where (Trs−Tr)max that is a maximum of the temperature differences (Trs−Tr) among the indoor units in an indoor thermostat ON state is larger than a predetermined temperature difference ΔTrc2 (e.g., 3° C.), the target refrigerant temperature changing part 84 performs slow changing control that corrects the target condensation temperature Tcs in such a way that the target condensation temperature Tcs becomes higher. That is, in a case where the room temperatures Tr are lower than the set temperatures Trs, the target refrigerant temperature changing part 84 determines that the temperature differences (Trs−Tr) meet the condition that it is necessary to raise the target condensation temperature Tcs.

In step ST14, assuming that the first amount of waiting time t1 (e.g., 10 minutes) has passed since the move to step ST12, the target refrigerant temperature changing part 84 performs slow changing control that changes the target condensation temperature Tcs in accordance with the temperature differences (Trs−Tr) between the room temperatures Tr of the air conditioned spaces targeted by the indoor units 4*a* and 4*b* and the set temperatures Trs that are target values of the room temperatures Tr. Here, in a case where the target refrigerant temperature changing part 84 has determined that the temperature differences (Trs−Tr) meet the condition that it is necessary to lower the target condensation temperature Tcs, the target refrigerant temperature changing part 84 reduces the condensation temperature correction value KTcc by subtracting a correction value ΔTcc2 (e.g., 1.5° C.) from the current condensation temperature correction value KTcc and adds the condensation temperature correction value KTcc to the reference target condensation temperature KTcb to thereby correct the target condensation temperature Tcs in such a way that the target condensation temperature Tcs becomes lower.

Here, as a condition of the temperature differences (Trs−Tr), also in a case where (Trs−Tr)max that is a maximum of the temperature differences (Trs−Tr) among the indoor units in an indoor thermostat ON state is equal to or less than a predetermined temperature difference ΔTrc3 (e.g., 1.5° C.), the target refrigerant temperature changing part 84 performs slow changing control that corrects the target condensation temperature Tcs in such a way that the target condensation temperature Tcs becomes lower. That is, in a case where the room temperatures Tr are in the vicinity of or higher than the set temperatures Trs, the target refrigerant temperature changing part 84 determines that the temperature differences (Trs−Tr) meet the condition that it is necessary to lower the target condensation temperature Tcs.

Then, after performing the processing of step ST13 or step ST14, the target refrigerant temperature changing part 84 returns to the processing of step ST12, and thereafter the processing of steps ST12, ST13, and ST14 is repeated.

Because of this slow changing mode, that is to say the slow changing control resulting from steps ST12, ST13, and ST14 during the heating operation, the target condensation temperature Tcs is slowly changed as shown in FIG. 8. For this reason, basically an excess of the air conditioning (heating) capacity of the outdoor unit 2 can be suppressed, efficiency is more easily improved, and energy conservation can be improved.

Moreover, here, the reference target condensation temperature KTcb is set in accordance with the outdoor temperature Ta by the automatic mode, so the target condensation temperature Tcs that is set as a result of a correction corresponding to the slow changing mode being made to the reference target condensation temperature KTcb can further improve the degree of energy conservation.

Moreover, here, the maximum value of the temperature differences between the room temperatures Tr and the set temperatures Trs among the indoor units in operation (in an indoor thermostat ON state) is used as a condition for changing the target condensation temperature Tcs. For this reason, the target condensation temperature Tcs is changed in accordance with the indoor unit in which the largest air conditioning (heating) capacity is required. Because of this, here, the target condensation temperature Tcs can be promptly changed and control trackability can be improved.

(Fast Changing Mode)

When the mode is set to the automatic mode and is set to the fast changing mode by the target refrigerant temperature mode setting part 83, during the cooling operation, the same slow changing control resulting from steps ST1 to ST4 as in the slow changing mode described above is performed, and in a case where the temperature differences (Tr−Trs) have exceeded a threshold temperature difference and the number of indoor units in operation has increased, as shown in step ST5 of FIG. 4, fast changing control is performed where the evaporation temperature correction value KTec and the target evaporation temperature Tes are forcibly changed to fast tracking evaporation temperatures (here, the maximum capacity evaporation temperature Tem and a lowest evaporation temperature Teex).

Specifically, in step ST5, assuming that the first amount of waiting time t1 (e.g., 10 minutes) has passed since the move to step ST2, in a case where (Tr−Trs)max that is a maximum of the temperature differences (Tr−Trs) among the indoor units in an indoor thermostat ON state is larger than the predetermined temperature difference ΔTre2 (e.g., 3° C.) serving as a threshold temperature difference and the current number of indoor units in an indoor thermostat ON state is larger than the number of indoor units in an indoor thermostat ON state an amount of time t3 (e.g., 30 seconds) before, the target refrigerant temperature changing part 84 performs fast changing control that corrects the target evaporation temperature Tes in such a way as to rapidly lower the target evaporation temperature Tes. That is, in a case where the number of indoor units in operation has increased (also including a case where an indoor unit in an indoor thermostat OFF state has switched to a thermostat ON state), a large air conditioning (cooling) capacity becomes necessary in the outdoor unit 2, and the target refrigerant temperature changing part 84 determines that this meets the condition that it is necessary to rapidly lower the target evaporation temperature Tes.

Here, the fast changing mode has a powerful mode and a quick mode. Additionally, in the powerful mode, in the case meeting the condition that it is necessary to rapidly lower the target evaporation temperature Tes, powerful changing control is performed which changes the evaporation temperature correction value KTec by subtracting the reference target evaporation temperature KTeb from the current evaporation temperature correction value KTec and adding a fast tracking evaporation temperature (here, a lowest evaporation temperature Teex exceeding the maximum capacity evaporation temperature Tem) and adds the evaporation temperature correction value Tec to the reference target evaporation temperature KTeb to thereby forcibly change the target evaporation temperature Tes to the lowest evaporation temperature Teex (e.g., 3° C.) serving as the fast tracking evaporation temperature. That is, the powerful mode is a mode that allows the target evaporation temperature Tes to be changed to the lowest evaporation temperature Teex exceeding the maximum capacity evaporation temperature Tem. Furthermore, in the quick mode, in the case meeting the condition that it is necessary to rapidly lower the target evaporation temperature Tes, quick changing control is performed which changes the evaporation temperature correction value KTec by subtracting the reference target evaporation temperature KTeb from the current evaporation temperature correction value KTec and adding a fast tracking evaporation temperature (here, a maximum capacity evaporation temperature Tem) and adds the evaporation temperature correction value KTec to the reference target evaporation temperature KTeb to thereby forcibly change the target evaporation temperature Tes to the maximum capacity evaporation temperature Tem (e.g., 6° C.) serving as the fast tracking evaporation temperature. That is, the quick mode is a mode that does not allow the target evaporation temperature Tes to be changed to the lowest evaporation temperature Teex. The changing of the evaporation temperature correction value KTec in the fast changing mode (the powerful mode and the quick mode) and the control that corrects the target evaporation temperature Tes by adding the evaporation temperature correction value KTec to the reference target evaporation temperature KTeb are also performed by the target refrigerant temperature changing part 84.

Then, after performing the processing of step ST5, the target refrigerant temperature changing part 84 returns to the processing of step ST2, and thereafter the processing of steps ST2, ST3, ST4, and ST5 is repeated.

Because of this fast changing mode, that is to say the fast changing control resulting from steps ST2, ST3, ST4, and ST5 during the cooling operation, as shown in FIG. 6, the target evaporation temperature Tes is changed in such a way that the room temperatures Tr reach the set temperatures Trs in a shorter amount of time compared to the case resulting from the slow changing mode (i.e., in the slow changing mode, the target evaporation temperature Tes is changed in such a way that the room temperatures Tr reach the set temperatures Trs in a longer amount of time than in the fast changing mode). For this reason, by setting the mode to the fast changing mode, control trackability can be improved compared to a case where the mode is set to the slow changing mode. Because of this, here, by setting the mode to the target refrigerant temperature changing mode, priority can be given to energy conservation, and at the same time the degree of control trackability can be changed according to the preference of the user.

Furthermore, here, in cases other than a case where the temperature differences between the room temperatures Tr and the set temperatures Trs exceed the threshold temperature difference (here, the predetermined temperature difference ΔTre2) and the number of indoor units in operation increases, the target evaporation temperature Tes is slowly changed by step ST3. For this reason, basically an excess of the air conditioning (cooling) capacity of the outdoor unit 2 can be suppressed. Moreover, here, in a case where the temperature differences between the room temperatures Tr and the set temperatures Trs exceed the threshold temperature difference (here, the predetermined temperature difference ΔTre2) and the number of indoor units in operation increases, that is to say a case where a large air conditioning (cooling) capacity becomes necessary in the outdoor unit 2 as a result of the number of indoor units in operation increasing, as shown in FIG. 7, the target evaporation temperature Tes is changed to a fast tracking evaporation temperature (here, the maximum capacity evaporation temperature Tem and the lowest evaporation temperature Teex) by performing fast changing control. Because of this, here, by changing the target evaporation temperature Tes, energy conservation can be improved, and sufficient control trackability can be obtained even in a case where the number of indoor units in operation increases.

Furthermore, here, the reference target evaporation temperature KTeb is set in accordance with the outdoor temperature Ta by the automatic mode, so the target evaporation temperature Tes that is set as a result of a correction corresponding to the fast changing mode being made to the reference target evaporation temperature KTeb can further improve the degree of energy conservation.

Furthermore, here, the maximum value of the temperature differences between the room temperatures Tr and the set temperatures Trs among the indoor units in operation (in an indoor thermostat ON state) is used as a condition for changing the target evaporation temperature Tes. For this reason, the target evaporation temperature Tes is changed in accordance with the indoor unit in which the largest air conditioning (cooling) capacity is required. Because of this, here, the target evaporation temperature Tes can be promptly changed and control trackability can be improved.

Furthermore, here, the fast changing mode (fast changing control) can be set to either of two modes (control)—the powerful mode (powerful changing control) and the quick mode (quick changing control)—in which the degree of control trackability is further different. Additionally, when the mode is set to the powerful mode, the target evaporation temperature Tes is allowed to be changed to the lowest evaporation temperature Teex exceeding the maximum capacity evaporation temperature Tem, so as shown in FIG. 7, control trackability is further improved compared to a case where the mode is set to the quick mode or a case where the mode is set to the target refrigerant temperature fixing mode. Because of this, here, by setting the mode to the fast changing mode, control trackability can be improved, and at the same time the degree of control trackability can be further changed according to the preference of the user.

Furthermore, when the mode is set to the automatic mode and is set to the fast changing mode by the target refrigerant temperature mode setting part 83, during the heating operation, the same slow changing control resulting from steps ST11 to ST14 as in the slow changing mode described above is performed, and in a case where the temperature differences (Trs−Tr) have exceeded the threshold temperature difference and the number of indoor units in operation has increased, as shown in step ST15 of FIG. 5, fast changing control is performed in which the condensation temperature correction value KTcc and the target condensation temperature Tcs are forcibly changed to fast tracking condensation temperatures (here, the maximum capacity condensation temperature Tcm and a highest condensation temperature Tcex).

Specifically, in step ST15, assuming that the first amount of waiting time t1 (e.g., 10 minutes) has passed since the move to step ST12, in a case where (Trs−Tr)max that is a maximum of the temperature differences (Trs−Tr) among the indoor units in an indoor thermostat ON state is larger than the predetermined temperature difference ΔTrc2 (e.g., 3° C.) serving as a threshold temperature difference and the current number of indoor units in an indoor thermostat ON state is larger than the number of indoor units in an indoor thermostat ON state an amount of time t3 (e.g., 30 seconds) before, the target refrigerant temperature changing part 84 performs fast changing control that corrects the target condensation temperature Tcs in such a way as to rapidly raise the target condensation temperature Tcs. That is, in a case where the number of indoor units in operation has increased (also including a case where an indoor unit in an indoor thermostat OFF state has switched to a thermostat ON state), a large air conditioning (heating) capacity becomes necessary in the outdoor unit 2, and the target refrigerant temperature changing part 84 determines that this meets the condition that it is necessary to rapidly raise the target condensation temperature Tcs.

Here, the fast changing mode has a powerful mode and a quick mode. Additionally, in the powerful mode, in the case meeting the condition that it is necessary to rapidly raise the target condensation temperature Tcs, powerful changing control is performed which changes the condensation temperature correction value KTcc by subtracting the reference target condensation temperature KTcb from the current condensation temperature correction value KTcc and adding a fast tracking condensation temperature (here, a highest condensation temperature Tcex exceeding the maximum capacity condensation temperature Tcm) and adds the condensation temperature correction value KTcc to the reference target condensation temperature KTcb to thereby forcibly change the target condensation temperature Tcs to the highest condensation temperature Tcex (e.g., 49° C.) serving as the fast tracking condensation temperature. That is, the powerful mode is a mode that allows the target condensation temperature Tcs to be changed to the highest condensation temperature Tcex exceeding the maximum capacity condensation temperature Tcm. Furthermore, in the quick mode, in the case meeting the condition that it is necessary to rapidly raise the target condensation temperature Tcs, quick changing control is performed which changes the condensation temperature correction value KTcc by subtracting the reference target condensation temperature KTcb from the current condensation temperature correction value KTcc and adding a fast tracking condensation temperature (here, the maximum capacity condensation temperature Tcm) and adds the condensation temperature correction value KTcc to the reference target condensation temperature KTcb to thereby forcibly change the target condensation temperature Tcs to the maximum capacity condensation temperature Tcm (e.g., 46° C.) serving as the fast tracking condensation temperature. That is, the quick mode is a mode that does not allow the target condensation temperature Tcs to be changed to the highest condensation temperature Tcex. The changing of the condensation temperature correction value KTcc in the fast changing mode (the powerful mode and the quick mode) and the control that corrects the target condensation temperature Tcs by adding the condensation temperature correction value KTcc to the reference target condensation temperature KTcb are also performed by the target refrigerant temperature changing part 84.

Then, after performing the processing of step ST15, the target refrigerant temperature changing part 84 returns to the processing of step ST12, and thereafter the processing of steps ST12, ST13, ST14, and ST15 is repeated.

Because of this fast changing mode, that is to say the fast changing control resulting from steps ST12, ST13. ST14, and ST15 during the heating operation, as shown in FIG. 8, the target condensation temperature Tcs is changed in such a way that the room temperatures Tr reach the set temperatures Trs in a shorter amount of time compared to the case resulting from the slow changing mode (i.e., in the slow changing mode, the target condensation temperature Tcs is changed in such a way that the room temperatures Tr reach the set temperatures Trs in a longer amount of time than in the fast changing mode). For this reason, by setting the mode to the fast changing mode, control trackability can be improved compared to a case where the mode is set to the slow changing mode. Because of this, here, by setting the mode to the target refrigerant temperature changing mode, priority can be given to energy conservation, and at the same time the degree of control trackability can be changed according to the preference of the user.

Furthermore, here, in cases other than a case where the temperature differences between the room temperatures Tr and the set temperatures Trs exceed the threshold temperature difference (here, the predetermined temperature difference ΔTrc2) and the number of indoor units in operation increases, the target condensation temperature Tcs is slowly changed by step ST13. For this reason, basically an excess of the air conditioning (heating) capacity of the outdoor unit 2 can be suppressed. Moreover, here, in a case where the temperature differences between the room temperatures Tr and the set temperatures Trs exceed the threshold temperature difference (here, the predetermined temperature difference ΔTrc2) and the number of indoor units in operation increases, that is to say a case where a large air conditioning (heating) capacity becomes necessary in the outdoor unit 2 as a result of the number of indoor units in operation increasing, as shown in FIG. 9, by performing fast changing control, the target condensation temperature Tcs is changed to a fast tracking condensation temperature (here, the maximum capacity condensation temperature Tcm and the highest condensation temperature Tcex). Because of this, here, by changing the target condensation temperature Tcs, energy conservation can be improved, and sufficient control trackability can be obtained even in a case where the number of indoor units in operation increases.

Furthermore, here, the reference target condensation temperature KTcb is set in accordance with the outdoor temperature Ta by the automatic mode, so the target condensation temperature Tcs that is set as a result of a correction corresponding to the fast changing mode being made to the reference target condensation temperature KTcb can further improve the degree of energy conservation.

Furthermore, here, the maximum value of the temperature differences between the room temperatures Tr and the set temperatures Trs among the indoor units in operation (in an indoor thermostat ON state) is used as a condition for changing the target condensation temperature Tcs. For this reason, the target condensation temperature Tcs is changed in accordance with the indoor unit in which the largest air conditioning (heating) capacity is required. Because of this, here, the target condensation temperature Tcs can be promptly changed and control trackability can be improved.

Furthermore, here, the fast changing mode (fast changing control) can be set to either of two modes (control)—the powerful mode (powerful changing control) and the quick mode (quick changing control)—in which the degree of control trackability is further different. Additionally, when the mode is set to the powerful mode, the target condensation temperature Tcs is allowed to be changed to the highest condensation temperature Tcex exceeding the maximum capacity condensation temperature Tcm, so as shown in FIG. 9, control trackability is further improved compared to a case where the mode is set to the quick mode or a case where the mode is set to the target refrigerant temperature fixing mode. Because of this, here, by setting the mode to the fast changing mode, control trackability can be improved, and at the same time the degree of control trackability can be further changed according to the preference of the user.

(Economy Mode)

When the mode is set to the automatic mode and is set to the economy mode by the target refrigerant temperature mode setting part 83, during the cooling operation, in contrast to the fast changing mode and the slow changing mode described above, the reference target evaporation temperature KTeb is set as the target evaporation temperature Tes without a correction being made to the reference target evaporation temperature KTeb that was set in the automatic mode (i.e., only a change corresponding to the outdoor temperature Ta is made).

Furthermore, when the mode is set to the automatic mode and is set to the economy mode by the target refrigerant temperature mode setting part 83, during the heating operation, in contrast to the fast changing mode and the slow changing mode described above, the reference target condensation temperature KTcb is set as the target condensation temperature Tcs without a correction being made to the reference target condensation temperature KTcb that was set in the automatic mode (i.e., only a change corresponding to the outdoor temperature Ta is made).

In this way, when the mode is set to the automatic mode of the target refrigerant temperature changing mode, the mode can be set to any of three modes including, in addition to the fast changing mode and the slow changing mode, the economy mode in which the way of correcting the reference target evaporation temperature KTeb or the reference target condensation temperature KTcb that has been set in the automatic mode is different. Additionally, when the mode is set to the economy mode, the target evaporation temperature Tes or the target condensation temperature Tcs is set without a correction being made to the reference target evaporation temperature KTeb or the reference target condensation temperature KTcb, so the degree of control trackability can be brought closest to the preference of the user. Because of this, here, by setting the mode to the automatic mode, the degree of energy conservation can be set, and at the same time the degree of control trackability can be changed according to the preference of the user.

—High-Sensitivity Mode—

In the high-sensitivity mode, in contrast to the automatic mode, the user sets the reference target evaporation temperature KTeb or the reference target condensation temperature KTcb. Specifically, when the mode is set to the high-sensitivity mode by the target refrigerant temperature mode setting part 83, the user can set the value of the reference target evaporation temperature KTeb or the reference target condensation temperature KTcb. Here, the user can set the reference target evaporation temperature KTeb by selecting any of several temperature values (e.g., 7, 8, 9, 10, and 11° C.) that are higher than the maximum capacity evaporation temperature Tem. Furthermore, the user can set the reference target condensation temperature KTcb by selecting any of several temperature values (e.g., 41 and 43° C.) that are lower than the maximum capacity condensation temperature Tcm.

Additionally, in the high-sensitivity mode, in contrast to the automatic mode, during the cooling operation or the heating operation, the user sets the reference target evaporation temperature KTeb or the reference target condensation temperature KTcb, and the target refrigerant temperature changing part 84 changes the target evaporation temperature Tes or the target condensation temperature Tcs by further making a correction according to the same slow changing mode or the fast changing mode as in the automatic mode or by not making a correction (economy mode).

In this way, here, when the mode is set to the target refrigerant temperature changing mode by the target refrigerant temperature mode setting part 83, the mode can be set to either of two modes—the automatic mode and the high-sensitivity mode—in which the way of setting the reference target evaporation temperature KTeb or the reference target condensation temperature KTcb is different. Additionally, when the mode is set to the automatic mode, as described above, the reference target evaporation temperature KTeb or the reference target condensation temperature KTcb is set in accordance with the outdoor temperature Ta, so the target evaporation temperature Tes or the target condensation temperature Tcs that is set as a result of a correction corresponding to the fast changing mode or the slow changing mode being made to the reference target evaporation temperature KTeb or the reference target condensation temperature KTcb can further improve the degree of energy conservation compared to a case where the mode is set to the high-sensitivity mode. On the other hand, when the mode is set to the high-sensitivity mode, the degree of energy conservation can be set according to the preference of the user. Because of this, here, by setting the mode to the target refrigerant temperature changing mode, priority can be given to energy conservation, and at the same time the degree of energy conservation can be changed according to the preference of the user.

(Slow Changing Mode)

When the mode is set to the high-sensitivity mode and is set to the slow changing mode by the target refrigerant temperature mode setting part 83, like in the case where the mode is set to the automatic mode, during the cooling operation, the evaporation temperature correction value KTec is changed as shown in steps ST1 to ST4 of FIG. 4. Additionally, the target evaporation temperature Tes is changed by making a correction that adds the evaporation temperature correction value KTec to the reference target evaporation temperature KTeb.

Furthermore, when the mode is set to the high-sensitivity mode and is set to the slow changing mode by the target refrigerant temperature mode setting part 83, like in the case where the mode is set to the automatic mode, during the heating operation also, the condensation temperature correction value KTcc is changed as shown in steps ST11 to ST14 of FIG. 5. Additionally, the target condensation temperature Tcs is changed by making a correction that adds the condensation temperature correction value KTcc to the reference target condensation temperature KTcb.

(Fast Changing Mode)

When the mode is set to the high-sensitivity mode and is set to the fast changing mode (the powerful mode or the quick mode) by the target refrigerant temperature mode setting part 83, during the cooling operation, the same slow changing control resulting from steps ST1 to ST4 as in the slow changing mode described above is performed, and in a case where the temperature differences (Tr−Trs) have exceeded the threshold temperature difference and the number of indoor units in operation has increased, as shown in step ST5 of FIG. 4, fast changing control (powerful changing control or quick changing control) is performed in which the evaporation temperature correction value KTec and the target evaporation temperature Tes are forcibly changed to fast tracking evaporation temperatures (here, the maximum capacity evaporation temperature Tem and the lowest evaporation temperature Teex).

Furthermore, when the mode is set to the high-sensitivity mode and is set to the fast changing mode (the powerful mode or the quick mode) by the target refrigerant temperature mode setting part 83, during the heating operation also, the same slow changing control resulting from steps ST11 to ST14 as in the slow changing mode described above is performed, and in a case where the temperature differences (Trs−Tr) have exceeded the threshold temperature difference and the number of indoor units in operation has increased, as shown in step ST15 of FIG. 5, fast changing control (powerful changing control or quick changing control) is performed in which the condensation temperature correction value KTcc and the target condensation temperature Tcs are forcibly changed to fast tracking condensation temperatures (here, the maximum capacity condensation temperature Tcm and the highest condensation temperature Tcex).

(Economy Mode)

When the mode is set to the high-sensitivity mode and is set to the economy mode by the target refrigerant temperature mode setting part 83, during the cooling operation, in contrast to the fast changing mode and the slow changing mode described above, the reference target evaporation temperature KTeb is set as the target evaporation temperature Tes without a correction being made to the reference target evaporation temperature KTeb that has been set in the high-sensitivity mode (i.e., in contrast to the automatic mode, without even a change corresponding to the outdoor temperature Ta being made).

Furthermore, when the mode is set to the high-sensitivity mode and is set to the economy mode by the target refrigerant temperature mode setting part 83, during the heating operation, in contrast to the fast changing mode and the slow changing mode described above, the reference target condensation temperature KTcb is set as the target condensation temperature Tcs without a correction being made to the reference target condensation temperature KTcb that has been set in the high-sensitivity mode (i.e., in contrast to the automatic mode, without even a change corresponding to the outdoor temperature Ta being made).

In this way, when the mode is set to the high-sensitivity mode of the target refrigerant temperature changing mode, the mode can be set to any of three modes including, in addition to the fast changing mode and the slow changing mode, the economy mode in which the way of correcting the reference target evaporation temperature KTeb or the reference target condensation temperature KTcb that has been set in the high-sensitivity mode is different. Additionally, when the mode is set to the economy mode, the target evaporation temperature Tes or the target condensation temperature Tcs is set without a correction being made to the reference target evaporation temperature KTeb or the reference target condensation temperature KTcb, so the degree of control trackability can be brought closest to the preference of the user. Because of this, here, by setting the mode to the high-sensitivity mode, the degree of energy conservation can be set, and at the same time the degree of control trackability can be changed according to the preference of the user.

(4) Example Modification 1

In the embodiment described above, as shown in FIG. 4 and FIG. 5, the target refrigerant temperature changing part 84 determines, every first amount of waiting time t1, whether or not the slow changing control (steps ST3, ST4, ST13, ST14) is necessary and also determines, every first amount of waiting time t1, whether or not the fast changing control (steps ST5, ST15) is necessary. For this reason, both in a case where an increase in the number of indoor units in operation occurs and in a case where this is not so, the target refrigerant temperature changing part 84 can perform control only every first amount of waiting time t1.

However, the fast changing control is performed in a case where the number of indoor units in operation increases, so it is preferable to ensure that the fast changing control can be promptly performed.

Figure 10:
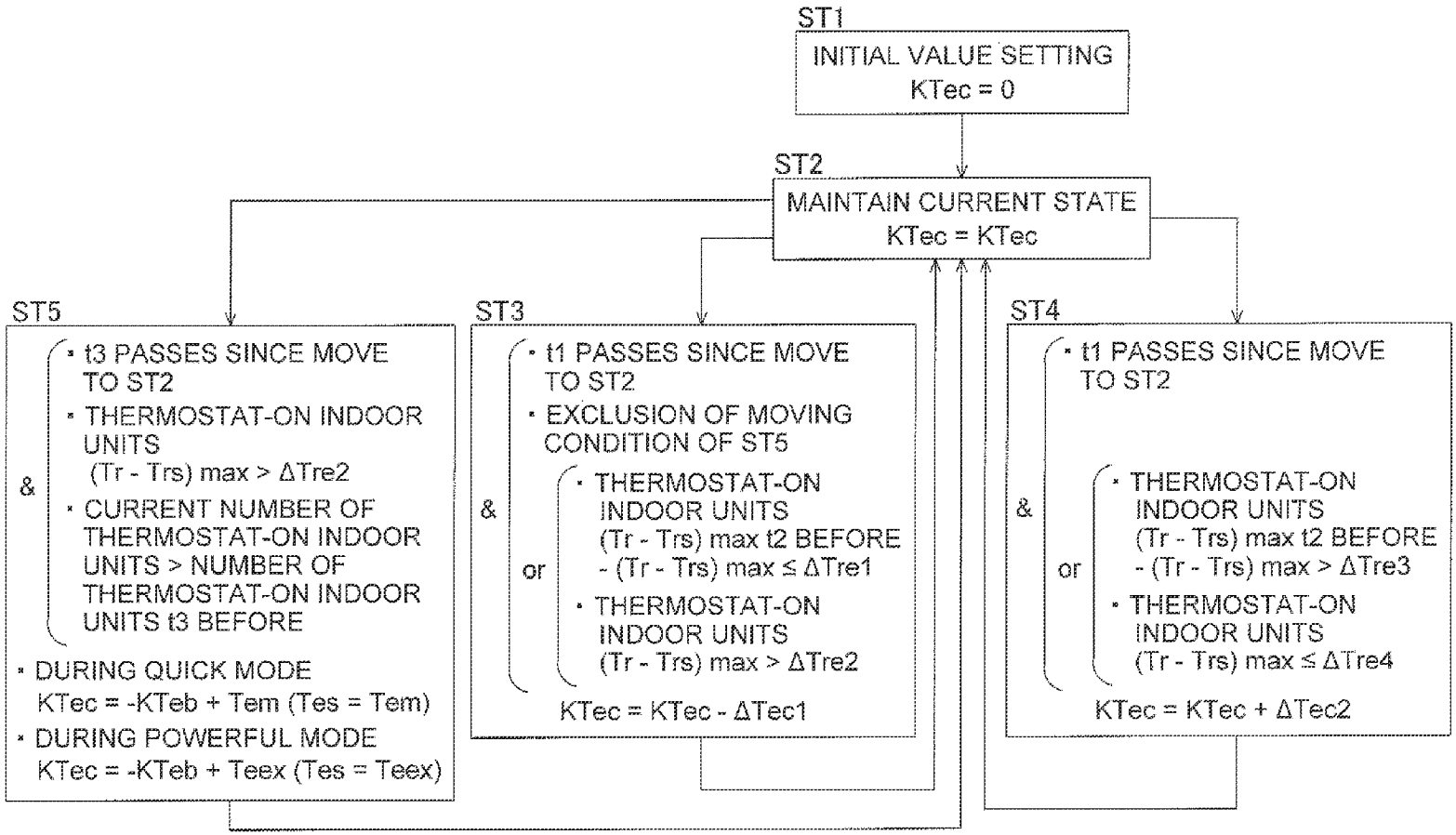
FIG. 10 is a flowchart showing control for correcting the target evaporation temperature in the slow changing mode and the fast changing mode (the quick mode and the powerful mode) in example modification 1.
Figure 11:
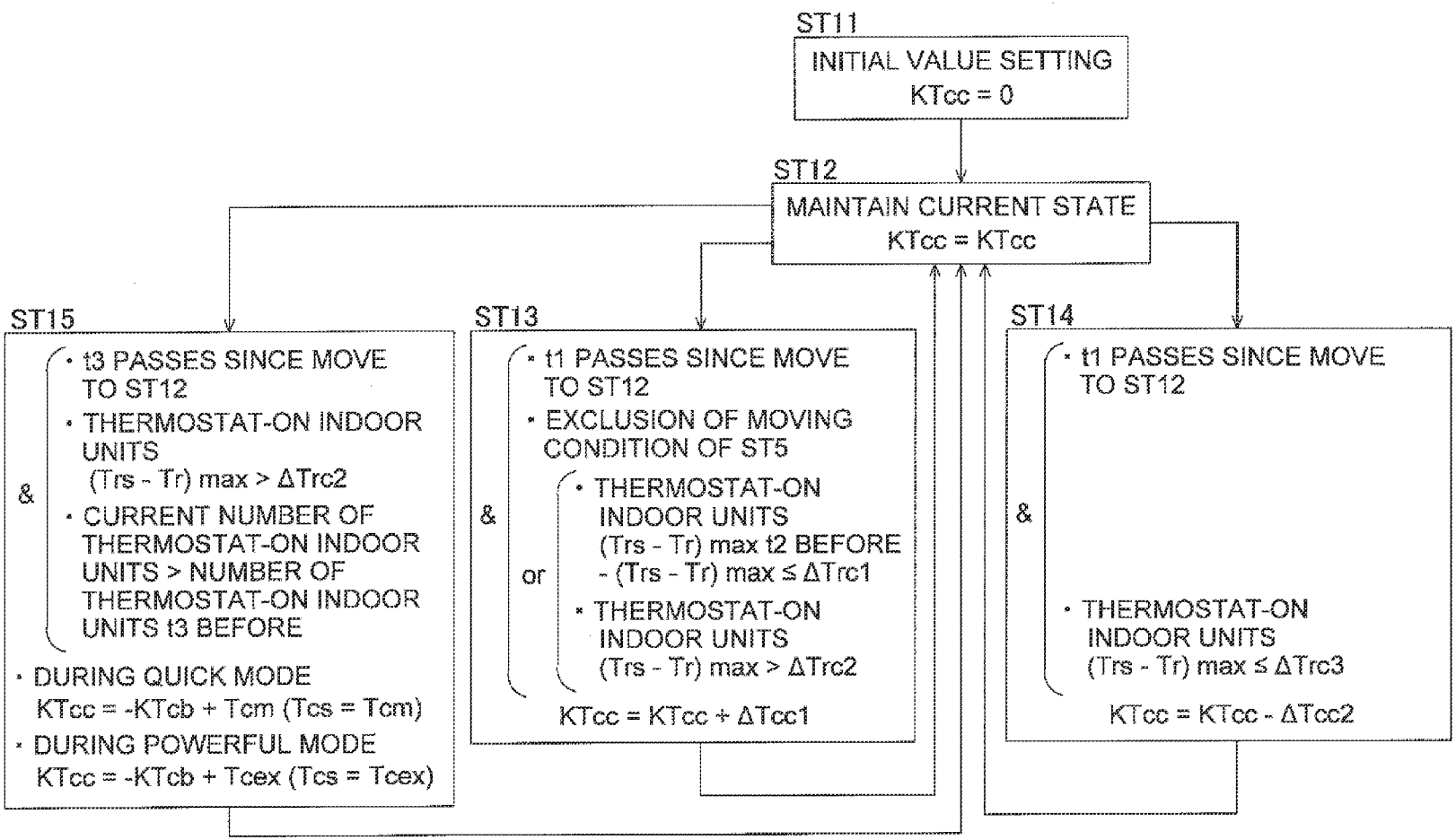
FIG. 11 is a flowchart showing control for correcting the target condensation temperature in the slow changing mode and the fast changing mode (the quick mode and the powerful mode) in example modification 1.

Therefore, here, as shown in FIG. 10 and FIG. 11, the target refrigerant temperature changing part 84 determines whether or not the slow changing control is necessary every time the first amount of waiting time t1 passes and determines whether or not the fast changing control is necessary every time a second amount of waiting time t3, which is shorter than the first amount of waiting time t1, passes.

For this reason, here, the fast changing control can be performed more frequently compared to the slow changing control, and the fact that the fast changing control has become necessary can be promptly detected.

Because of this, here, the control trackability of the fast changing control can be improved.

(5) Example Modification 2

In the embodiment described above and example modification 1, the reference target evaporation temperature KTeb is set in accordance with the outdoor temperature Ta in the automatic mode and is set by the user in the high-sensitivity mode. Here, for example, in an operating state in which the outdoor temperature Ta is high and the room temperatures Tr are low, there can be cases where the humidity in the air conditioned spaces becomes higher than the relative humidity (usually about 60%) suitable for the room temperatures Tr. When the relative humidity becomes higher, discomfort increases in the air conditioned spaces, so this kind of operating state needs to be avoided.

Therefore, here, the reference target evaporation temperature KTeb is restricted to be equal to or less than an upper limit evaporation temperature that has been set in accordance with the room temperatures Tr. For example, the upper limit evaporation temperature can be set on the basis of a function of the room temperatures Tr. Here, the relative humidity tends to become lower the higher the room temperatures Tr are, so the upper limit evaporation temperature is set on the basis of a function in which the upper limit evaporation temperature becomes higher as the room temperatures Tr become higher.

For this reason, here, the reference target evaporation temperature KTeb that is set in the automatic mode and the high-sensitivity mode is restricted to be equal to or less than the upper limit evaporation temperature that has been set in accordance with the room temperatures Tr, so the humidity in the air conditioned spaces can be made equal to or less than the relative humidity suitable for the room temperatures Tr.

Because of this, here, discomfort in the air conditioned spaces can be suppressed, and at the same time the degree of energy conservation and the degree of control trackability can be changed according to the preference of the user.

(6) Example Modification 3

In the embodiment described above and example modifications 1 and 2, the target refrigerant temperature mode setting part 83 is disposed in the outdoor-side control unit 38, but it is not limited to these. For example, although it is not illustrated in the drawings, in a case where the air conditioning apparatus 1 has a central control device such as a central remote controller that collectively controls the plural indoor units (and also plural outdoor units in a case where the air conditioning apparatus 1 has plural outdoor units), the target refrigerant temperature mode setting part 83 may be disposed in the central control device. In this case, it becomes possible to more easily perform the mode setting described above.

INDUSTRIAL APPLICABILITY

The present invention is widely applicable to air conditioning apparatuses equipped with a refrigerant circuit configured as a result of plural indoor units being connected to an outdoor unit.

What is claimed is:

1. An air conditioning apparatus equipped with a refrigerant circuit configured with plural indoor units connected to an outdoor unit, the air conditioning apparatus comprising:

a capacity controlling part controlling an air conditioning capacity of the outdoor unit such that an evaporation temperature of refrigerant in the refrigerant circuit becomes a target evaporation temperature; and a target refrigerant temperature mode setting part setting a target refrigerant temperature mode to one of a target refrigerant temperature changing mode that changes the target evaporation temperature, and a target refrigerant temperature fixing mode that fixes the target evaporation temperature, the target refrigerant temperature changing mode having a first changing mode that changes the target evaporation temperature in such a way that room temperatures of air conditioned spaces targeted by the indoor units reach set temperatures that are target values of the room temperatures in an amount of time, and a second changing mode that changes the target evaporation temperature in such a way that the room temperatures reach the set temperatures in a longer amount of time than in the first changing mode, and the first changing mode and the second changing mode being set by the target refrigerant temperature mode setting part.

2. The air conditioning apparatus according to claim 1, wherein in the target refrigerant temperature fixing mode, the target evaporation temperature is fixed to a maximum capacity evaporation temperature corresponding to a case in which an air conditioning capacity of the outdoor unit is at 100% capacity.

3. The air conditioning apparatus according to claim 2, wherein the first changing mode has a first sub-mode that allows the target evaporation temperature to be changed to a lowest evaporation temperature exceeding the maximum capacity evaporation temperature and a second sub-mode that does not allow the target evaporation temperature to be changed to the lowest evaporation temperature or the highest condensation temperature, and the first sub-mode and the second sub-mode are set by the target refrigerant temperature mode setting part.

4. The air conditioning apparatus according to claim 1, wherein the target refrigerant temperature changing mode further has an automatic mode that sets a reference target evaporation temperature serving as a reference value of the target evaporation temperature in accordance with an outdoor temperature of an outside space where the outdoor unit is disposed and a user-set mode in which a user sets the reference target evaporation temperature, the first changing mode and the second changing mode are set, together with the automatic mode or the user-set mode, by the target refrigerant temperature mode setting part, and the target evaporation temperature is changed by making, with respect to the reference target evaporation temperature, a correction corresponding to the first changing mode or the second changing mode.

5. The air conditioning apparatus according to claim 4, wherein the target refrigerant temperature changing mode further has an economy mode in which the reference target evaporation temperature that has been set in the automatic mode or the user-set mode is set as the target evaporation temperature without a correction being made to the reference target evaporation temperature, and the economy mode is set, together with the automatic mode or the user-set mode, by the target refrigerant temperature mode setting part.

6. The air conditioning apparatus according to claim 4, wherein the reference target evaporation temperature is restricted to be no more than an upper limit evaporation temperature that has been set in accordance with the room temperatures.

7. The air conditioning apparatus according to claim 2, wherein the target refrigerant temperature changing mode further has an automatic mode that sets a reference target evaporation temperature serving as a reference value of the target evaporation temperature in accordance with an outdoor temperature of an outside space where the outdoor unit is disposed and a user-set mode in which a user sets the reference target evaporation temperature, the first changing mode and the second changing mode are set, together with the automatic mode or the user-set mode, by the target refrigerant temperature mode setting part, and the target evaporation temperature is changed by making, with respect to the reference target evaporation temperature, a correction corresponding to the first changing mode or the second changing mode.

8. The air conditioning apparatus according to claim 7, wherein the target refrigerant temperature changing mode further has an economy mode in which the reference target evaporation temperature that has been set in the automatic mode or the user-set mode is set as the target evaporation temperature without a correction being made to the reference target evaporation temperature, and the economy mode is set, together with the automatic mode or the user-set mode, by the target refrigerant temperature mode setting part.

9. The air conditioning apparatus according to claim 7, wherein the reference target evaporation temperature is restricted to be no more than an upper limit evaporation temperature that has been set in accordance with the room temperatures.

10. The air conditioning apparatus according to claim 3, wherein the target refrigerant temperature changing mode further has an automatic mode that sets a reference target evaporation temperature serving as a reference value of the target evaporation temperature in accordance with an outdoor temperature of an outside space where the outdoor unit is disposed and a user-set mode in which a user sets the reference target evaporation temperature, the first changing mode and the second changing mode are set, together with the automatic mode or the user-set mode, by the target refrigerant temperature mode setting part, and the target evaporation temperature is changed by making, with respect to the reference target evaporation temperature, a correction corresponding to the first changing mode or the second changing mode.

11. The air conditioning apparatus according to claim 10, wherein the target refrigerant temperature changing mode further has an economy mode in which the reference target evaporation temperature that has been set in the automatic mode or the user-set mode is set as the target evaporation temperature without a correction being made to the reference target evaporation temperature, and the economy mode is set, together with the automatic mode or the user-set mode, by the target refrigerant temperature mode setting part.

12. The air conditioning apparatus according to claim 10, wherein the reference target evaporation temperature is restricted to be no more than an upper limit evaporation temperature that has been set in accordance with the room temperatures.

13. An air conditioning apparatus equipped with a refrigerant circuit configured with plural indoor units connected to an outdoor unit, the air conditioning apparatus comprising:

a capacity controlling part controlling an air conditioning capacity of the outdoor unit such that a condensation temperature of refrigerant in the refrigerant circuit becomes a target condensation temperature; and a target refrigerant temperature mode setting part setting a target refrigerant temperature mode to one of a target refrigerant temperature changing mode that changes the target condensation temperature, and a target refrigerant temperature fixing mode that fixes the target condensation temperature, the target refrigerant temperature changing mode having a first changing mode that changes the target condensation temperature in such a way that room temperatures of air conditioned spaces targeted by the indoor units reach set temperatures that are target values of the room temperatures in an amount of time, and a second changing mode that changes the target condensation temperature in such a way that the room temperatures reach the set temperatures in a longer amount of time than in the first changing mode, and the first changing mode and the second changing mode being set by the target refrigerant temperature mode setting part.

14. The air conditioning apparatus according to claim 13, wherein in the target refrigerant temperature fixing mode, the target condensation temperature is fixed to a maximum capacity condensation temperature corresponding to a case in which an air conditioning capacity of the outdoor unit is at 100% capacity.

15. The air conditioning apparatus according to claim 14, wherein the first changing mode has a first sub-mode that allows the target condensation temperature to be changed to a highest condensation temperature exceeding the maximum capacity condensation temperature and a second sub-mode that does not allow the target condensation temperature to be changed to the highest condensation temperature, and the first sub-mode and the second sub-mode are set by the target refrigerant temperature mode setting part.

16. The air conditioning apparatus according to claim 13, wherein the target refrigerant temperature changing mode further has an automatic mode that sets a reference target condensation temperature serving as a reference value of the target condensation temperature in accordance with an outdoor temperature of an outside space where the outdoor unit is disposed and a user-set mode in which a user sets the reference target condensation temperature, the first changing mode and the second changing mode are set, together with the automatic mode or the user-set mode, by the target refrigerant temperature mode setting part, and the target condensation temperature is changed by making, with respect to the reference target condensation temperature, a correction corresponding to the first changing mode or the second changing mode.

17. The air conditioning apparatus according to claim 16, wherein the target refrigerant temperature changing mode further has an economy mode in which the reference target condensation temperature that has been set in the automatic mode or the user-set mode is set as the target condensation temperature without a correction being made to the reference target condensation temperature, and the economy mode is set, together with the automatic mode or the user-set mode, by the target refrigerant temperature mode setting part.

18. The air conditioning apparatus according to claim 14, wherein the target refrigerant temperature changing mode further has an automatic mode that sets a reference target condensation temperature serving as a reference value of the target condensation temperature in accordance with an outdoor temperature of an outside space where the outdoor unit is disposed and a user-set mode in which a user sets the reference target condensation temperature, the first changing mode and the second changing mode are set, together with the automatic mode or the user-set mode, by the target refrigerant temperature mode setting part, and the target condensation temperature is changed by making, with respect to the reference target condensation temperature, a correction corresponding to the first changing mode or the second changing mode.

19. The air conditioning apparatus according to claim 18, wherein the target refrigerant temperature changing mode further has an economy mode in which the reference target condensation temperature that has been set in the automatic mode or the user-set mode is set as the target condensation temperature without a correction being made to the reference target condensation temperature, and the economy mode is set, together with the automatic mode or the user-set mode, by the target refrigerant temperature mode setting part.

20. The air conditioning apparatus according to claim 15, wherein the target refrigerant temperature changing mode further has an automatic mode that sets a reference target condensation temperature serving as a reference value of the target condensation temperature in accordance with an outdoor temperature of an outside space where the outdoor unit is disposed and a user-set mode in which a user sets the reference target condensation temperature, the first changing mode and the second changing mode are set, together with the automatic mode or the user-set mode, by the target refrigerant temperature mode setting part, and the target condensation temperature is changed by making, with respect to the reference target condensation temperature, a correction corresponding to the first changing mode or the second changing mode.

21. The air conditioning apparatus according to claim 20, wherein the target refrigerant temperature changing mode further has an economy mode in which the reference target condensation temperature that has been set in the automatic mode or the user-set mode is set as the target condensation temperature without a correction being made to the reference target condensation temperature, and the economy mode is set, together with the automatic mode or the user-set mode, by the target refrigerant temperature mode setting part.

* * * * *